US011053753B2

(12) United States Patent
Wijning et al.

(10) Patent No.: US 11,053,753 B2
(45) Date of Patent: Jul. 6, 2021

(54) OFFSHORE SUBSEA WELLBORE ACTIVITIES SYSTEM AND METHOD

(71) Applicant: ITREC B.V., Schiedam (NL)

(72) Inventors: Diederick Bernardus Wijning, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/470,051

(22) PCT Filed: Dec. 14, 2017

(86) PCT No.: PCT/NL2017/050838
§ 371 (c)(1),
(2) Date: Jun. 14, 2019

(87) PCT Pub. No.: WO2018/111103
PCT Pub. Date: Jun. 21, 2018

(65) Prior Publication Data

US 2020/0011141 A1 Jan. 9, 2020

(30) Foreign Application Priority Data

Dec. 16, 2016 (NL) ..... 2018018

(51) Int. Cl.
*E21B 15/02* (2006.01)
*E21B 19/00* (2006.01)
(Continued)

(52) U.S. Cl.
CPC ..... *E21B 19/006* (2013.01); *E21B 15/02* (2013.01); *E21B 19/09* (2013.01); *E21B 19/146* (2013.01); *E21B 19/22* (2013.01)

(58) Field of Classification Search
CPC ..... E21B 15/02; E21B 19/006; E21B 19/09; E21B 19/143; E21B 19/146; E21B 19/22
See application file for complete search history.

(56) References Cited

U.S. PATENT DOCUMENTS 8,162,062 B1 4/2012 Barone et al.
9,611,706 B2 * 4/2017 Pinckard ..... E21B 19/006
(Continued)

FOREIGN PATENT DOCUMENTS

GB 2 418 684 A 4/2006
WO WO 2014/182160 A2 11/2014
(Continued)

OTHER PUBLICATIONS

International Search Report, issued in PCT/NL2017/050838, dated Jan. 19, 2018.
(Continued)

*Primary Examiner* — Matthew R Buck
(74) *Attorney, Agent, or Firm* — Birch, Stewart, Kolasch & Birch, LLP

(57) ABSTRACT

An offshore subsea wellbore activities system and method wherein use is made of a tower and a motion arm assembly with vertical drive adapted to move the motion arm along a vertical motion arm rail relative to the tower. Also use is made of a wellbore activities device comprising a riser tension frame having an upper frame section, a lower frame section provided with a riser attachment device adapted to attach a riser to said lower frame section so as to extend in a firing line, and a vertical riser load bearing structure, e.g. formed by struts. The wellbore activities device further comprises a coiled tubing injector, a wireline lubricator, and one or more pressure control devices associated with the coiled tubing injector and/or the wireline lubricator received by and individually movable within the riser tension frame. The wellbore activities device provides a lateral firing line access passage allowing to transfer an elongated wellbore tool or a wellbore tubular in vertical orientation thereof by means of the motion arm assembly in a substantially lateral motion between and a remote position outside of the riser
(Continued)

tension frame and an operative position within the riser tension frame and aligned with the firing line.

33 Claims, 22 Drawing Sheets

(51) Int. Cl.
*E21B 19/09* (2006.01)
*E21B 19/14* (2006.01)
*E21B 19/22* (2006.01)

(56) References Cited

U.S. PATENT DOCUMENTS

2012/0318530 A1* 12/2012 Wollum ..... E21B 15/00 166/379
2013/0213662 A1* 8/2013 Beck ..... E21B 19/004 166/351
2014/0308105 A1 10/2014 Soertveit et al.
2015/0096761 A1* 4/2015 Roodenburg ..... E21B 19/006 166/355

FOREIGN PATENT DOCUMENTS

WO WO 2015/051156 A2 4/2015
WO WO-2015133895 A1 * 9/2015 ..... E21B 19/002

OTHER PUBLICATIONS

Written Opinion of the International Searching Authority, issued in PCT/NL2017/050838, dated Jan. 19, 2018.

* cited by examiner

OFFSHORE SUBSEA WELLBORE ACTIVITIES SYSTEM AND METHOD

FIELD OF THE INVENTION

The present invention relates to the field of offshore wellbore activities, e.g. drilling a wellbore, completion of a wellbore, wellbore intervention or servicing, and/or other activities that relate to a subsea wellbore.

BACKGROUND OF THE INVENTION

In WO2014/182160 an offshore vessel with a wellbore activities installation is disclosed which comprises:

tower, a rig floor having a well center through which a tubulars string can pass along a firing line, a tubulars storage rack adjacent the tower for storage therein of multi-joint tubular stands, at least one vertical trolley rail extending along the tower, a trolley, said trolley being guided along said at least one vertical trolley rail, a top drive device attached to the trolley, said top drive device comprising one or more top drive motors, e.g. electric top drive motors, adapted to impart rotary motion to a tubulars string when connected to said top drive device, a hoisting device adapted to move the trolley with the top drive device up and down along said at least one vertical trolley rails, a vertical motion arm rail extending along the tower, a motion arm assembly comprising a base and an extensible and retractable motion arm, wherein the base is guided said at least one vertical motion arm rail, and wherein the motion arm has an operative reach that encompasses the firing line, said motion arm assembly being adapted to support at least one of a well center tool, e.g. an iron roughneck tool, or a tubular gripper member, and allowing to bring said well center tool or tubular gripper member in the firing line, e.g. allowing to operate the motion arm assembly as a piperacker for transfer of tubular stands between the storage rack and the firing line, a vertical motion arm drive adapted to move the motion arm base along said vertical motion arm rail.

In the offshore wellbore activities field operations are performed that involve the use of coiled tubing equipment including a coiled tubing injector and/or wireline equipment including a wireline lubricator. Also operations are performed that involve the use of a so-called riser tension frame, sometimes with one of said coiled tubing injector or wireline lubricator installed in the tension frame. Herein the frame is adapted to attach to the top end of a riser in the firing line. For example a riser tension frame is suspended from a heave motion compensated hoisting device so as to keep the riser tensioned while the offshore vessel is subjected to heave motion. This can e.g. be done with a fixed length tension frame. Other know riser tension frames have an integrated heave motion compensator assembly, e.g. the structure of the frame including heave motion cylinders as part of the structure of the tension frame, e.g. vertical structural legs of the frame including such cylinders. Sometimes this integrated motion compensator assembly is normally locked, so non-operative, making the riser tension frame act like a fixed length frame. The integrated motion compensator assembly is then merely provided as a back-up for the heave motion compensated hoisting device from which the tension frame is suspended in heave motion compensating mode.

It is known in the field to install in a riser tension frame one or more of a coiled tubing injector, a wireline lubricator, and one or more pressure control devices associated with said coiled tubing injector and/or said wireline lubricator. Examples of such known wellbore activities systems are described in WO2015/051156, U.S. Pat. No. 8,162,062.

Another operation common in this field is running of a tubulars string, e.g. in well completion wherein a production tubulars string is run into a subsea wellbore, wherein one or more control lines are fitted to the outside of the tubulars string. Oil and/or gas produced by the well are conveyed to the wellhead by this production tubulars string. The completion of a well using production tubing, but also some other operations running some kind of tubular string, requires the installation of control lines for electrically, hydraulically and/or optically linking various downhole devices to the wellhead and/or the surface. Control lines may be used to receive data from downhole instruments, e.g. to monitor, regulate and stimulate the flow of the fluids through the production tubing string, e.g. by selectively operating, from the surface, downhole devices such as valves, switches, sensors, relays or other devices. Control and signal lines may carry electric signals, electrical power, hydraulic signals and/or power, optic signals, pneumatic signals and/or power, etc. It is common practice to use clamps to secure these lines at intervals, e.g. at the location of threaded connectors connecting one tubular to another, to the tubulars string. Commonly this is done manually by an operator standing at a level below a slip device from which the tubulars string is suspended in the firing line.

OBJECT OF THE INVENTION

The present invention aims to provide measures that form an improvement over existing offshore subsea wellbore activities systems, e.g. with respect to versatility, efficiency, reliability, use of deck and/or other storage space for equipment, etc.

SUMMARY OF THE INVENTION

According to a first aspect thereof the invention provides an offshore subsea wellbore activities system comprising:

an offshore vessel having a hull subjected to heave motion, said vessel being provided with:

a tower, a hoisting device, e.g. heave compensated and providing a heave compensation mode, a vertical motion arm rail along said tower, a motion arm assembly comprising a base and an extensible and retractable motion arm, wherein the base is guided by said at least one vertical motion arm rail, a motion arm assembly vertical drive which is adapted to move the motion arm base along said vertical motion arm rail relative to the tower, a wellbore activities device comprising a riser tension frame, wherein said riser tension frame comprises:

an upper frame section adapted to be suspended or suspended from said heave compensated hoisting device, a lower frame section provided with a riser attachment device adapted to attach a riser to said lower frame section so as to extend in a firing line, vertical riser load bearing struts connecting said lower frame section to said upper frame section, wherein said wellbore activities device further comprises:

a coiled tubing injector, a wireline lubricator, one or more pressure control devices associated with said coiled tubing injector and/or said wireline lubricator, wherein each of said coiled tubing injector and said wireline lubricator is received by and individually movable within said riser tension frame between a parking position remote from said firing line and an operative position aligned with said firing line allowing to use a selected one of said coiled tubing injector and said wireline lubricator for performing a coiled tubing operation or a wireline operation respectively when aligned with the firing line, and wherein the wellbore activities device provides a lateral firing line access passage having a height of at least 40 ft. (12.2 m) and a width of at least 1 ft. (0.35 m) allowing to transfer an elongated wellbore tool or a wellbore tubular in vertical orientation thereof by means of the motion arm assembly in a substantially lateral motion between and a remote position outside of the riser tension frame and an operative position within the riser tension frame and aligned with the firing line.

This system is very versatile and efficient as the wellbore activities device allows for switching between coiled tubing operation and wireline operation, which is frequently desired in the field. Moreover the system allows to use the motion arm assembly in the process of handling for example an elongated wellbore tool that has to be fitted at the leading end of the coiled tubing that is to be deployed. Such wellbore tools are often called bottomhole assembly or BHA, and may include one or more of a downhole motor, sensitive electronics, perforator equipment, packers, valves, etc. The inventive system allows to reliably handle such a relatively expensive and fragile tool by means of the motion arm assembly in order to bring the tool in the firing line. In embodiments the motion arm assembly can be used to stab the tool into the riser, e.g. at least in part, and/or the tool is then suspended from a winch cable that extends vertically in the firing line for vertical handling of the tool in the firing line.

The system of the first aspect of the invention may also include one or more of the features discussed in the subclaims and/or in the description of the figures and/or discussed with reference to another aspect of the invention.

For example the system further comprises:

at least one tubulars storage rack adjacent the tower and adapted to store therein tubulars, preferably multi-joint tubulars, in vertical orientation, a tubular gripper member adapted to be provided on said motion arm and to grip a tubular, so that said tubular is displaceable by means of said motion arm between the storage rack and said firing line.

For example the vertical riser load bearing structure is formed by exactly three vertical riser load bearing struts connecting said lower frame section to said upper frame section in a triangular arrangement, including one rear strut arranged at a rear side of the tension frame facing the tower and two front struts at a front side of the tension frame.

For example the lower frame section is releasably secured to said vertical riser load bearing structure, e.g. to said struts, and the lower frame section comprises a platform adapted to stand on a rig floor in an operative position over the well center.

For example the lower frame section supports, above a platform thereof, at least one of said coiled tubing injector, said wireline lubricator, and said one or more pressure control devices associated with said coiled tubing injector and/or said wireline lubricator.

For example the lower frame section is releasably secured to the vertical riser load bearing structure, and the lower frame section comprises a platform provided with downward projecting support legs protruding beneath the platform and adapted to stand on a rig floor in an operative position over the well center, wherein said platform is at an elevated position above the rig floor.

For example the system further comprises a slip device adapted to support a tubulars string suspended from said slip device, wherein the lower frame section is adapted to receive and retain said slip device.

For example the lower frame section is releasably connected to the vertical riser load bearing structure of the tension frame.

For example the lower frame section comprises a platform wherein centrally a riser top connector is arranged that is to be aligned with the firing line.

For example the lower frame section, e.g. the platform thereof, is provided with a CT storage stand to store thereon a coiled tubing (CT) pressure control device and with a WL storage stand to store thereon a wireline (WL) pressure control device, e.g. wherein said CT storage stand and said WL storage stand are arranged on diametrically opposed location relative to a central riser top connector.

For example the lower frame section has a platform whereon horizontal rails are provided.

For example the lower frame section, e.g. a platform thereof, is provided with CT pressure control device carrier that travels over rails and is adapted to carry and displace the CT pressure control device from a CT storage stand to the firing line for connection to the riser top connector and vice versa.

For example the lower frame section, e.g. a platform thereof, is provided with WL pressure control device carrier that travels over rails and is adapted to carry and displace the WL pressure control device from the WL storage stand to the firing line for connection to a riser top connector and vice versa.

For example vertical riser load bearing struts, e.g. exactly three in a triangular arrangement, connect the lower frame section to the upper frame section.

For example connecting struts are each connected at an upper end thereof via a releasable connection, e.g. via a removable connector pin, to the upper frame section.

For example connecting struts are each connected at a lower end thereof via a releasable connection, e.g. via a removable connector pin, to said lower frame section.

For example the upper and/or lower frame section each comprises sockets that are each adapted to receive therein a spigot end of a strut, wherein for each releasable connection a transverse connector pin is provided that extends through aligned apertures in the socket and the spigot end of the strut.

For example the lower frame section is releasably secured to the vertical load bearing structure, e.g. said struts, and the lower frame section comprises a platform adapted to stand on a rig floor in an operative position over the well center, possibly provided with downward projecting support legs protruding beneath the platform so that said platform stands at an elevated position above the rig floor.

For example the lower frame section is provided with a mobile arm structure having one or more mobile arms, e.g. pivotally connected to the lower frame section, and the mobile arm structure is provided with one or more rail engagement members, e.g. rollers sets, adapted to engage on one or more of said vertical rails, e.g. on trolley rails.

For example the system comprises:

a pair of parallel skid rails provided on a rig floor and extending along opposed sides of the well center, a skid pallet adapted to be skidded over said skid rails provided on the rig floor, wherein said lower frame section is adapted to be releasably secured to said skid pallet so as to allow skidding of the complete riser tension frame or of the lower frame section with said at least one of said coiled tubing injector, said wireline lubricator, and said one or more pressure control devices associated with said coiled tubing injector and/or said wireline lubricator supported thereon, from a remote storage position to a position in the firing line.

For example the system comprises:

one or more vertical trolley rails along the tower, a trolley suspended from the hoisting device and movable along said one or more vertical trolley rails, a top drive device supported by the trolley, wherein the riser tension frame is directly suspended from the trolley, the vertical riser load not being transferred through any part of the top drive device, e.g. the trolley being provided with a pair of mobile tensile links that depend from the trolley and are connected or connectable to the top frame section of the riser tension frame, e.g. the tensile links each having an eyelet at the lower end thereof and the tension frame top section having opposed hooks that can be mated with an eyelet, e.g. a left-hand and right-hand hook.

For example the system comprises:

one or more vertical trolley rails along the tower, a trolley suspended from the hoisting device and movable along said one or more vertical trolley rails, a top drive device supported by the trolley, wherein the riser tension frame is directly suspended from the trolley, the vertical riser load not being transferred through any part of the top drive device, and wherein the riser tension frame and the trolley have a spigot and socket connection arrangement, e.g. at the location of the top end of a rear strut, so as to obtain a positioning and stabilizing of the frame relative to the trolley by said spigot and socket connection.

The first aspect of the invention also relates to an offshore subsea wellbore activities system comprising:

an offshore vessel having a hull subjected to heave motion, said vessel being provided with:

a tower, a rig floor having a well center on a firing line, at least one tubulars storage rack adjacent the tower and adapted to store therein tubulars, preferably multi-joint tubulars, in vertical orientation, at least one vertical trolley rail along said tower, a hoisting device, e.g. heave compensated and providing a heave compensation mode, a vertical motion arm rail along said tower, a motion arm assembly comprising a base and an extensible and retractable motion arm, wherein the base is guided by said at least one vertical motion arm rail, a motion arm assembly vertical drive which is adapted to move the motion arm base along said vertical motion arm rail relative to the tower, a tubular gripper member adapted to be provided on said motion arm and to grip a tubular, so that said tubular is displaceable by means of said motion arm between the storage rack and said firing line, a wellbore activities device comprising a riser tension frame, wherein said riser tension frame comprises:

an upper frame section adapted to be suspended or suspended from said heave compensated hoisting device, a lower frame section provided with a riser attachment device adapted to attach a riser to said lower frame section so as to extend in a firing line, vertical riser load bearing struts connecting said lower frame section to said upper frame section, wherein said wellbore activities device further comprises:

a coiled tubing injector, a wireline lubricator, one or more pressure control devices associated with said coiled tubing injector and/or said wireline lubricator, wherein each of said coiled tubing injector and said wireline lubricator is received by and individually movable within said riser tension frame between a parking position remote from said firing line and an operative position aligned with said firing line allowing to use a selected one of said coiled tubing injector and said wireline lubricator for performing a coiled tubing operation or a wireline operation respectively when aligned with the firing line, and wherein the wellbore activities device provides a lateral firing line access passage having a height of at least 40 ft. and a width of at least 1 ft. allowing to transfer an elongated wellbore tool or a wellbore tubular in vertical orientation thereof by means of the motion arm assembly in a substantially lateral motion between and a remote position outside of the riser tension frame and an operative position within the riser tension frame and aligned with the firing line.

It will be appreciated that here the versatility of the system is very great as the motion arm assembly, when fitted with the tubular gripper member, can also be employed to handle tubulars stored in the storage rack. For example, possibly in combination with one or more additional motion arm assemblies, e.g. on the same vertical rail, the motion arm assembly can be operated as a piperacker during a drilling operation wherein no use is made of the riser tension frame.

In embodiments the tubular gripper member is employed to handle a wellbore tool to be transferred between the firing line within the riser tension frame and the outside of said frame, e.g. said wellbore tool being stored in the storage rack. The wellbore tool may have a section, e.g. releasably insertable between components or modules of the wellbore tool, dedicated to be gripped by the tubular gripper member.

The first aspect of the invention also relates to an offshore subsea wellbore activities system comprising:

an offshore vessel having a hull subjected to heave motion, said vessel being provided with:

a tower, a hoisting device, e.g. heave compensated providing a heave compensation mode, a vertical motion arm rail along said tower, a motion arm assembly comprising a base and an extensible and retractable motion arm, wherein the base is guided by said at least one vertical motion arm rail, a motion arm assembly vertical drive which is adapted to move the motion arm base along said vertical motion arm rail relative to the tower, a wellbore activities device comprising a riser tension frame, wherein said riser tension frame comprises:

an upper frame section adapted to be suspended or suspended from said heave compensated hoisting device, a lower frame section provided with a riser attachment device adapted to attach a riser to said lower frame section so as to extend in a firing line, and wherein said riser tension frame has exactly three vertical riser load bearing struts connecting said lower frame section to said upper frame section in a triangular arrangement, including one rear strut arranged at a rear side of the tension frame facing the tower and two front struts at a front side of the tension frame, and wherein said wellbore activities device further comprises:

at least one of a coiled tubing injector and a wireline lubricator, one or more pressure control devices associated with said coiled tubing injector and/or said wireline lubricator, wherein each of said coiled tubing injector and/or said wireline lubricator is received by and individually movable within said riser tension frame between a parking position remote from said firing line and an operative position aligned with said firing line allowing to use said coiled tubing injector and/or said wireline lubricator for performing a coiled tubing operation or a wireline operation respectively when aligned with the firing line, and wherein the wellbore activities device provides a lateral firing line access passage having a height of at least 40 ft. and a width of at least 1 ft. allowing to transfer an elongated wellbore tool or a wellbore tubular in vertical orientation thereof by means of the motion arm assembly in a substantially lateral motion between and a remote position outside of the riser tension frame and an operative position within the riser tension frame and aligned with the firing line.

Here the riser tension frame is provided with exactly three vertical riser load bearing struts connecting said lower frame section to said upper frame section in a triangular arrangement, seen in horizontal cross-section, including one rear strut arranged at a rear side of the tension frame facing the tower and two front struts at a front side of the tension frame. This arrangement provides on the one hand a very stable structure of the tension frame, e.g. compared to known frames having exactly two struts which results in a more or less planar framework, e.g. that is less effective in an embodiment wherein the frame has to carry both the coiled tubing injector and the wireline lubricator as well as one or more pressure control devices associated with the coiled tubing injector and/or the wireline lubricator (e.g. two complete BOP ram stacks). Compared to a four struts design of the frame, the provision of just three, with one at the rear and two at the front, for enhanced integration of the described lateral firing line access passage as well as optimization of stresses on the struts and weight of the complete tension frame. For example using struts that are releasable from both the upper and lower frame section, the vertical riser load will more effectively be distributed over three legs than over four legs.

The first aspect of the invention also relates to a method for performing a wellbore activity wherein use is made of the system, e.g. for performing an offshore wireline operation wherein use is made of a system to move a wellbore tool into the firing line, which tool is to be connected to the wireline. Similarly the method may include a coiled tubing operation and the motion arm of the system is used to move a coiled tubing tool into the firing line. For example a tool is brought from a position outside the riser tension frame to a position within the tension frame and aligned with the firing line as well as above the wireline lubricator by means of the motion arm assembly.

A second aspect of the invention relates to an offshore subsea wellbore activities system comprising:

an offshore vessel having a hull subjected to heave motion, said vessel being provided with:

a tower, a hoisting device, e.g. heave compensated and providing a heave compensation mode, a wellbore activities device comprising a riser tension frame, wherein said riser tension frame comprises:

an upper frame section adapted to be suspended or suspended from said hoisting device, a lower frame section provided with a riser attachment device adapted to attach a riser to said lower frame section so as to extend in a firing line, vertical riser load bearing structure, e.g. formed by multiple struts, e.g. exactly three struts, connecting said lower frame section to said upper frame section, wherein said wellbore activities device further comprises:

at least one of a coiled tubing injector and a wireline lubricator, one or more pressure control devices associated with said coiled tubing injector and/or said wireline lubricator, wherein said tension frame is adapted to support said at least one of a coiled tubing injector and a wireline lubricator, and said one or more pressure control devices associated with said coiled tubing injector and/or said wireline lubricator, and wherein said lower frame section is releasably secured to said vertical riser load bearing structure, e.g. to said struts, and wherein said lower frame section comprises a platform adapted to stand on the rig floor in an operative position over the well center, and wherein said lower frame section supports, above the platform, at least one of said coiled tubing injector, said wireline lubricator, and said one or more pressure control devices associated with said coiled tubing injector and/or said wireline lubricator.

This system of the second aspect of the invention allows for the multi-functionality of the lower frame section of the riser tension frame, at least including this lower frame section playing its role as structural load bearing part of the tension frame and including the lower frame section being detached from the remainder of the riser tension frame and standing on the rig floor in operative position over the well center. As at least one of one of the coiled tubing injector, wireline lubricator, and one or more pressure control devices associated with said coiled tubing injector and/or said wireline lubricator are supported on this lower frame section above the platform, this equipment can readily be used when the lower frame section stand, detached from the rest of the frame, on the rig floor. For example the lower frame section than stands on skid rails provided on the rig floor. For example the lower frame section then is used for coiled tubing and/or wireline operations. In another embodiment it is envisaged that a slip device is placed on, or even integrated with, the lower frame section, as to allow the lower section to keep a tubulars string suspended from the slip device in the firing line.

The second aspect of the invention also relates to an offshore subsea wellbore activities system comprising:

an offshore vessel having a hull subjected to heave motion, said vessel being provided with:

a tower, a hoisting device, e.g. heave compensated providing a heave compensation mode, a rig floor having a well center, a wellbore activities device comprising a riser tension frame, wherein said riser tension frame comprises:

an upper frame section adapted to be suspended or suspended from said hoisting device, a lower frame section provided with a riser attachment device adapted to attach a riser to said lower frame section so as to extend in a firing line, vertical riser load bearing structure, e.g. formed by struts, e.g. formed by exactly three struts, connecting said lower frame section to said upper frame section, wherein said wellbore activities device further comprises:

at least one of a coiled tubing injector and a wireline lubricator, one or more pressure control devices associated with said coiled tubing injector and/or said wireline lubricator, wherein said tension frame is adapted to support said at least one of a coiled tubing injector and a wireline lubricator, and said one or more pressure control devices associated with said coiled tubing injector and/or said wireline lubricator, and wherein said lower frame section is releasably secured to said struts and wherein said lower frame section comprises a platform provided with downward projecting support legs protruding beneath the platform and adapted to stand on the rig floor adapted to stand on the rig floor in an operative position over the well center, wherein said platform is at an elevated position above the rig floor, and wherein said system further comprises a slip device adapted to support a tubulars string suspended from said slip device, and wherein the platform of the lower frame section is adapted to receive and retain said slip device.

The second aspect of the invention also relates to an offshore subsea wellbore activities system comprising:

an offshore vessel having a hull subjected to heave motion, said vessel being provided with:

a tower, one or more vertical rails extending along said tower, a hoisting device, e.g. heave motion compensated providing a heave compensation mode, a wellbore activities device comprising a riser tension frame, wherein said riser tension frame comprises:

an upper frame section adapted to be suspended or suspended from said hoisting device, a lower frame section provided with a riser attachment device adapted to attach a riser to said lower frame section so as to extend in a firing line, vertical riser load bearing struts connecting said lower frame section to said upper frame section, wherein said wellbore activities device further comprises:

at least one of a coiled tubing injector and a wireline lubricator, one or more pressure control devices associated with said coiled tubing injector and/or said wireline lubricator, wherein said tension frame is adapted to support said at least one of a coiled tubing injector and a wireline lubricator, and said one or more pressure control devices associated with said coiled tubing injector and/or said wireline lubricator, and wherein said lower frame section is releasably secured to said struts and wherein said lower frame section comprises a platform adapted to stand on the rig floor adapted to stand on the rig floor in an operative position over the well center, possibly provided with downward projecting support legs protruding beneath the platform so that said platform stands at an elevated position above the rig floor, and wherein the lower frame section is provided with a mobile arm structure having one or more mobile arms, e.g. pivotally connected to the lower frame section, and wherein said mobile arm structure is provided with one or more rail engagement members, e.g. rollers sets, adapted to engage on one or more of said vertical rails.

The provision of a mobile arm structure allows to use this arm structure as part of the guidance of the tension frame relative to the tower when the frame is operated in heave compensating mode. In stored position of the lower frame section or of the entire tension frame the mobile arm structure can be brought into a retracted or collapsed mode wherein the arm structure takes up little space.

In a preferred embodiment, the one or more vertical rails on which the mobile arm structure engages extend so low that even when the lower frame structure is placed on the rig floor the arm structure can be brought into proper engagement with said one or more vertical rails. This e.g. allows the arm structure to act as a stabilizer for the lower frame structure that is standing on the rig floor, e.g. absorbing—at least in part—forces in the horizontal plane acting on the lower frame section in the course of operations being performed. Also the arm structure may act to properly position the lower frame section relative to the firing line when standing on the rig floor, e.g. to achieve alignment with the firing line and thus with a top drive device that may travel up and down above the lower section.

The second aspect of the invention also relates to a riser tension frame for use in offshore subsea wellbore activities aboard an offshore vessel having a hull subjected to heave motion, wherein the riser tension frame comprises:

an upper frame section adapted to be suspended or suspended from a hoisting device, a lower frame section provided with a riser attachment device adapted to attach a riser to said lower frame section so as to extend in a firing line, a vertical riser load bearing structure, e.g. formed by struts, e.g. exactly three struts, connecting said lower frame section to said upper frame section, wherein, possibly, said lower frame section is releasably connected to said vertical riser load bearing structure of the tension frame, wherein said lower frame section comprises a platform wherein centrally a riser top connector is arranged that is to be aligned with the firing line, and wherein the platform is provided with a CT storage stand to store thereon a coiled tubing (CT) pressure control device and with a WL storage stand to store therein a wireline (WL) pressure control device, wherein said CT storage stand and said WL storage stand are arranged on diametrically opposed location relative to said central riser top connector, wherein rails are provided on said platform, and wherein the platform is provided with CT pressure control device carrier that travels over said rails and is adapted to carry and displace the CT pressure control device from the CT storage stand to the firing line for connection to the riser top connector and vice versa, and wherein the platform is provided with WL pressure control device carrier that travels over said rails and is adapted to carry and displace the WL pressure control device from the WL storage stand to the firing line for connection to the riser top connector and vice versa.

The second aspect of the invention also relates to an offshore subsea wellbore activities system comprising:

an offshore vessel having a hull subjected to heave motion, said vessel being provided with:

a tower, a rig floor with a well center arranged on a firing line, a pair of parallel skid rails provided on said rig floor and extending along opposed sides of the well center, a firing line hoisting device, for example providing a heave compensation mode, a wellbore activities device comprising a riser tension frame, wherein said riser tension frame comprises:

an upper frame section adapted to be suspended or suspended from said firing line hoisting device, a lower frame section provided with a riser attachment device adapted to attach a riser to said lower frame section so as to extend in a firing line, vertical riser load bearing structure, e.g. formed by struts, connecting said lower frame section to said upper frame section, wherein said wellbore activities device further comprises:

at least one of a coiled tubing injector and a wireline lubricator, one or more pressure control devices associated with said coiled tubing injector and/or said wireline lubricator, and wherein said lower frame section is releasably secured to said vertical riser load bearing structure of the riser tension frame and wherein said lower frame section comprises a platform adapted to stand on the rig floor in an operative position over the well center, and wherein said lower frame section supports, above the work platform, at least one of said coiled tubing injector, said wireline lubricator, and said one or more pressure control devices associated with said coiled tubing injector and/or said wireline lubricator, a skid pallet adapted to be skidded over said skid rails provided on the rig floor, wherein said lower frame section is adapted to be releasably secured to said skid pallet so as to allow skidding of the complete riser tension frame or of the lower frame section with said at least one of said coiled tubing injector, said wireline lubricator, and said one or more pressure control devices associated with said coiled tubing injector and/or said wireline lubricator supported thereon, from a remote storage position to a position in the firing line by means of the skid pallet.

A third aspect of the invention relates to a riser tension frame for use in offshore subsea wellbore activities aboard an offshore vessel having a hull subjected to heave motion, wherein the riser tension frame comprises:

an upper frame section adapted to be suspended or suspended from said heave compensated hoisting device, a lower frame section provided with a riser attachment device adapted to attach a riser to said lower frame section so as to extend in a firing line, vertical riser load bearing struts connecting said lower frame section to said upper frame section, e.g. exactly three struts, wherein said struts are each connected at an upper end thereof via a releasable connection, e.g. via a removable connector pin, to said upper frame section, and wherein said struts are each connected at a lower end thereof via a releasable connection, e.g. via a removable connector pin, to said lower frame section, e.g. wherein said upper and lower frame section each comprises sockets that are each adapted to receive therein a spigot end of a strut, wherein for each releasable connection a transverse connector pin is provided that extends through aligned apertures in the socket and the spigot end of the strut.

The third aspect of the invention also relates to a method for onboard assembly of a riser tension frame for use in offshore subsea wellbore activities aboard an offshore vessel having a hull subjected to heave motion, wherein the riser tension frame comprises:

an upper frame section adapted to be suspended or suspended from said heave compensated hoisting device, a lower frame section provided with a riser attachment device adapted to attach a riser to said lower frame section so as to extend in a firing line, vertical riser load bearing struts adapted to connect said lower frame section to said upper frame section, e.g. exactly three struts, wherein said upper and lower frame section each comprises sockets that are each adapted to receive therein a spigot end of a strut, wherein for each releasable connection a transverse connector pin is provided that extends through aligned apertures in the socket and the spigot end of the strut, wherein said lower frame section is positioned within reach of a crane, wherein said vertical riser load bearing struts are raised by said crane and placed vertically with their spigot ends in the sockets of the lower frame section and then secured therein by means of said transverse connector pins, and wherein, subsequently, the upper frame section is placed on the vertically arranged struts by means of the crane so that the spigot ends of the struts are received in the corresponding sockets of the upper frame section and then secured therein by means of said transverse connector pins.

The riser tension frame of the third aspect of the invention allows for assembly and disassembly, e.g. in view of storage when not in use. Also one can envisage lengthening of shortening of the frame depending on the planned operations to be performed by exchanging one length of struts for another length of struts. The struts, when disassembled, can e.g. be stored horizontally. As explained herein, in embodiments, the lower frame section is also embodied for use when detached from the tension frame, e.g. standing on the rig floor over the well center or even supported on heave motion compensator cylinders that extend underneath the lower frame section (e.g. between the lower frame section and the rig floor). When the lower section is used as stand-alone component it is desirable to allow for storage of the remainder of the tension frame in disassembled state so as to reduce storage spaced requirements.

In an embodiment it is envisaged that the struts, when disassembled, as stored horizontally belowdecks in a storage hold within the hull, e.g. within a hold that is also used for horizontal storage of riser sections or stands.

The riser tension frame is preferably embodied with the struts being fixed length monolithic steel struts, e.g. of rectangular cross section. One or more of the struts may be, possibly permanently, fitted with walkways and/or stairs to allow personnel to have access to, for example, one or more of a coiled tubing injector, wireline lubricator, wellbore tool position within the frame (e.g. in the firing line), or other components, etc. in the tension frame.

A fourth aspect of the invention relates to an offshore subsea wellbore activities system comprising:

an offshore vessel having a hull subjected to heave motion, said vessel being provided with:

a tower, one or more vertical rails extending along said tower, a hoisting device, e.g. heave motion compensated providing a heave compensation mode, a wellbore activities device comprising a frame section that is placed on top of a group of heave motion compensation cylinders, e.g. on four of such cylinders, configured to allow the frame section to perform a heave compensating motion in an associated range of travel along the tower.

In an embodiment the frame section is provided with a riser attachment device adapted to attach a riser to said frame section so as to extend in a firing line.

In an embodiment the frame section comprises a platform wherein centrally a riser top connector is arranged that is to be aligned with the firing line.

In an embodiment the frame section is provided with a coiled tubing injector and associated pressure control device and/or with a wireline lubricator and associated pressure control device.

In an embodiment the frame section placed on top of a group of heave motion compensation cylinders is provided with a mobile arm structure having one or more mobile arms, e.g. pivotally connected to the frame section, wherein said mobile arm structure is provided with one or more rail engagement members, e.g. rollers sets, adapted to engage on one or more of said vertical rails on the tower.

In an embodiment the frame section placed on top of a group of heave motion compensation cylinders comprises a platform, which platform is provided with a CT storage stand to store thereon a coiled tubing (CT) pressure control device and with a WL storage stand to store therein a wireline (WL) pressure control device, wherein said CT storage stand and said WL storage stand are arranged on diametrically opposed locations relative to a central riser top connector, and wherein the platform is provided with CT pressure control device carrier that travels over rails and is adapted to carry and displace the CT pressure control device from the CT storage stand to the firing line for connection to the riser top connector and vice versa, and wherein the platform is provided with WL pressure control device carrier that travels over rails and is adapted to carry and displace the WL pressure control device from the WL storage stand to the firing line for connection to the riser top connector and vice versa.

In an embodiment a coiled tubing injector is fitted on top of the coiled tubing pressure control device as a unit, wherein the carrier is adapted to move said unit between the parked position and the operative position in the firing line.

In another embodiment the frame section placed on top of a group of heave motion compensation cylinders is provided with a separate carrier for a coiled tubing injector, allowing to move the coiled tubing injector separate from an associated pressure control device.

In another embodiment the frame section placed on top of a group of heave motion compensation cylinders is provided with a separate carrier for a wireline lubricator, allowing to move the wireline lubricator separate from an associated pressure control device.

In an embodiment an intermediate horizontal frame member is fitted in the structure of the frame section at a level above the one or more pressure control devices, with one or more carriers being provided on said intermediate horizontal frame member to perform transfer of a coiled tubing injector and/or of a wireline lubricator, each between a respective parked position and a firing line position. For example such an additional carrier may include a lifting mechanism adapted to lift and lower the carried injector and/or lubricator relative to the associated pressure control device in view of making and breaking the connection.

In an embodiment the frame section comprises a platform and wherein a surface flow tree that may be arranged in a top region of a riser is mounted below the platform.

The fourth aspect of the invention also relates to a method for performing wellbore activities wherein use is made of the system comprising a frame section that is placed on top of a group of heave motion compensation cylinders, e.g. on four of such cylinders, configured to allow the frame section to perform a heave compensating motion in an associated range of travel along the tower.

It will be appreciated that any aspect discussed herein, and (optional) detailed features thereof, can also be combined with one or more of the other aspects of the invention.

It will be appreciated that the present invention also relates to a riser tension frame as discussed herein for use in wellbore activities on a heave motion subjected vessel and to such use thereof.

The present invention also relates to methods wherein use is made of a system and/or riser tension frame and/or lower riser frame section and/or frame section supported on top of a group of heave motion compensation cylinders as described herein.

The various aspects of the invention will now be described in more detail with reference to non-limiting embodiments, some of them shown in the drawings.

DESCRIPTION OF EMBODIMENTS

Figure 1:
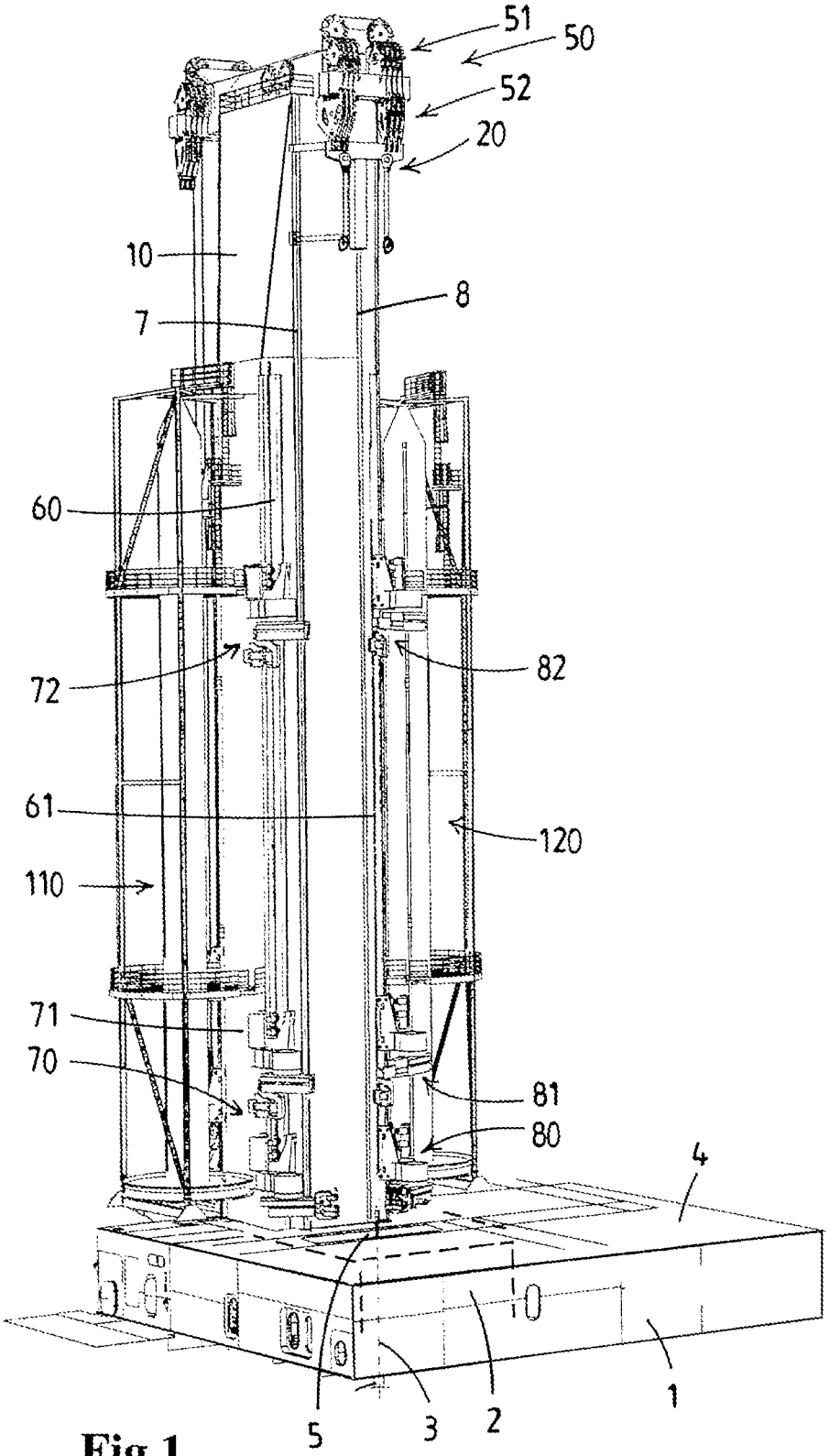
FIG. 1 shows a part of an offshore vessel for use in a wellbore activities system according to the invention with a tower, trolley, vertical rails on the tower, multi-joint tubular stand storage racks, a rig floor, a moonpool, rig floor skid rails, etc.

FIG. 1 shows a part of the hull 1 of an offshore vessel, here with a moonpool 2 through which imaginary firing line 3 extends to the subsea site of a wellbore or wellhead or other subsea equipment.

It is envisaged that the depicted an offshore vessel is adapted for performing offshore drilling and/or other wellbore related activities, e.g. well completion, well intervention, etc.

FIG. 1 shows a tower 10 that is here embodied as a mast with a closed contoured steel structure with the firing line 3 outside of the mast itself. Here the mast 10 is arranged adjacent the moonpool. In another embodiment the tower 1 could be a derrick over the moonpool, so that the firing line 3 extends within the framework of the derrick. Other arrangement, e.g. with the mast 10 arranged over an elongated moonpool to form two moonpool areas, e.g. front and aft of the mast 10, are equally known and possible.

FIG. 1 shows a rig floor 4 and a well center 5.

Figure 30:
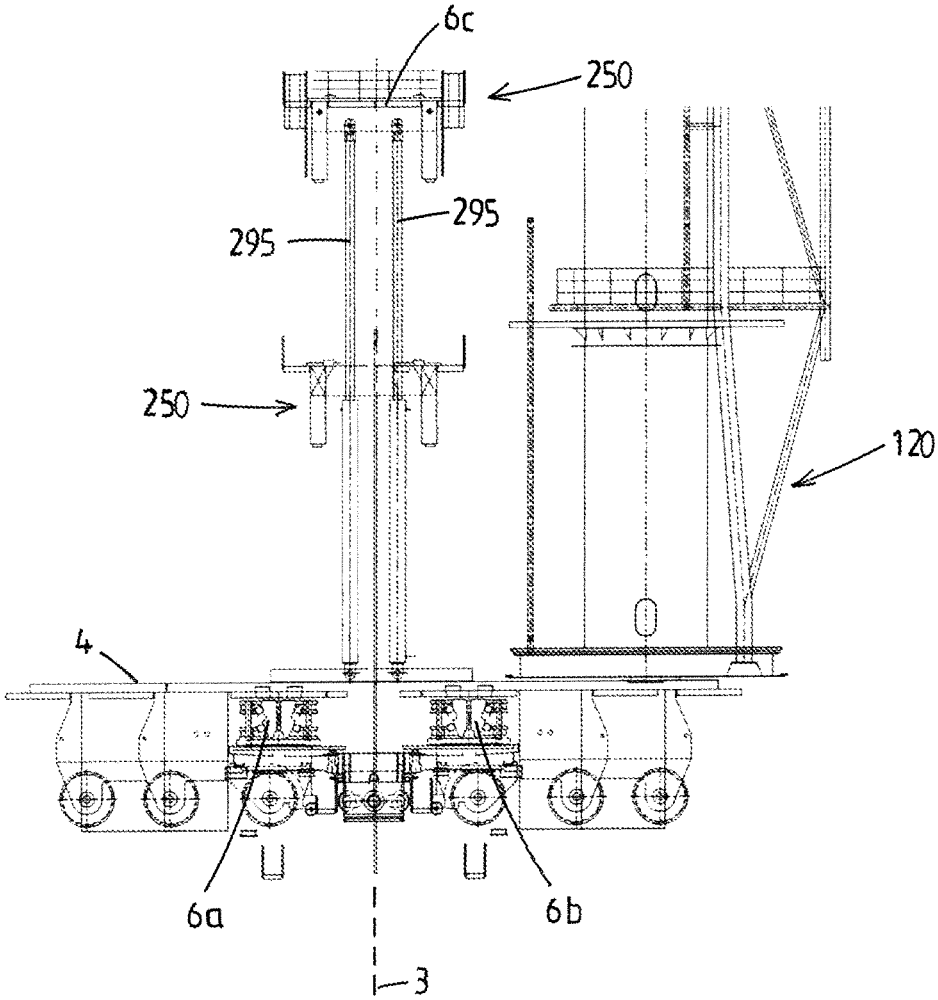
FIG. 30 illustrates the use of the lower frame section of the riser tension frame of FIG. 3 in a heave compensated mode, wherein the lower frame section is supported on multiple heave motion compensation cylinders that extend from the rig floor upward.

As shown in FIG. 30 one or more slip devices can be arranged at or near the well center. FIG. 30 shows two such slip devices 6*a, b* in a sunken compartment below the surface of the rig floor. The slip devices 6*a, b* are movable, e.g. skiddable between opposed parking positions remote from the firing line and an operative position aligned with the firing line 3. As known in the art a slip device 6*a, b* can retain a suspended tubular string, e.g. during drilling operations, including tripping in and out of the wellbore.

The mast 1 is at the side of the well center 5 provided with two parallel vertical trolley rails 7, 8.

A trolley 20 is guided along the trolley rails 7,8.

A top drive device 30 is attached to the trolley 20.

The top drive device 30 comprises in this example four electric top drive motors 31 which commonly drive, via gearbox or transmission in housing 32, a rotary stem or quill 33. As known in the art the quill 33 is connectable, e.g. via a threaded connection, e.g. via a saver sub, to the top end of a tubular aligned with the firing line. Thereby the top drive device 30 is able to impart rotary motion and drive torque to a tubulars string.

A main firing line hoisting device 50, often called drawworks, is provided and is adapted to move the trolley 20 with the top drive device 30 up and down along the vertical trolley rails 7,8. Here the hoisting device 50 comprises a crown block 51, a travelling block 52, and a hoisting cable arranged in a multiple fall arrangement between said blocks 51, 52. The travelling block 52 here is fitted to the frame of the trolley 20. One or more winches of the hoisting device, e.g. arranged within or underneath the mast 10, operate the hoisting cable. These one or more winches may be heave compensated winches as is known in the art and/or one or more other heave compensation devices may be arranged to act on the cable, e.g. on the cable stretch between the one or more winches and the crown block 51 as is known in the art. This allows to move the travelling block 52, and thus the trolley 20, in a heave compensating mode.

A left-hand motion arm rail 60 and a right-hand motion arm rail 61 are present on opposed lateral sides of a vertical path of travel of the trolley 20 with the top drive device 30 along said the vertical trolley rails 7,8.

On each of said motion arm rails 60, 61 at least one, here three as is preferred, motion arm assembly 70, 71, 72, 80, 81, 82 is arranged. Each assembly is, as preferred independently controlled from any other motion arm assembly on the same rail 60, 61, vertically mobile along the respective rail by a respective motion arm assembly vertical drive.

As is preferred the assemblies 70, 71, 72, 80, 81, 82 have an identical structure. For example with reference to FIG. 8 it is shown that the assembly 71 has a base 74 that is mounted vertically mobile on the vertical rail 60.

The assembly 71 further comprises an extensible and retractable motion arm 75, here a telescopic arm with a first arm section 75*a* connected to the base 74, and one or more, here two, telescopic second and third arm sections 75*b*, 75*c*. For example the arm sections are extensible by associated hydraulic cylinders of the arm 75. The motion arm has an operative reach that encompasses the firing line 3 so that the arm can handle drilling tubulars and/or well center equipment, or other tooling that needs to be presented or held in the firing line. As is preferred the arm 75, here the first arm section 75*a*, is connected to the base 74 via a slew bearing 76 allowing to rotate the arm about a vertical axis by means of an associated slew drive.

The assembly 70 further comprises a motion arm assembly vertical drive, e.g. with one or more motors 78 each driving a pinion meshing with a rack that extends along the rail 60. Thereby the base 74 can move along the at least one vertical motion arm rail 60 and, for example, the drive with motor 78 is sufficiently strong to do so while the motion arm assembly carries a load in the firing line 3 of at least 1000 kg, preferably at least 5000 kg.

At the end of the motion arm 75 a mechanical coupler part is provided. By means of the coupler part the motion arm assembly 70, here each of the depicted motion arm assemblies, is able to support at least one of a well center tool, e.g. an iron roughneck tool 85, or a tubular gripper member 90, and allowing to bring said well center tool or tubular gripper member in the firing line.

For this reason each of said tubular gripper members 90 and/or the iron roughneck tool 85 is provided with a mechanical coupler part that is adapted to be mated with the mechanical coupler part that is fitted on the motion arm 75 such that the respective gripper member, iron roughneck tool, or other well center tool, becomes fixed to the respective motion arm and fully and directly follows any motion of the motion arm.

Left and right of the mast 10 the depicted vessel has a tubulars storage rack 110, 120, here embodied as carrousels as is known in the art, adapted to store therein multi-joint tubular stands, e.g. triples, quads, or even stands of six joints, in vertical orientation therein. The tubular stands can comprises drill pipe, casing, etc.

As is known in the art, by means of two or three of the motion arm assemblies 70, 71, 72, 80, 81, 82 a multi-joint tubular can be gripped by said assemblies in unison and then transferred between a storage rack 110, 120 on the one hand and a position over the well center 5 in the firing line 3. So the motion arm assembly is, as is preferred, usable as part of a piperacker. Of course it will be possible to grip and carry one tubular joint or something similar, even when much heavier, by means of a single motion arm assembly, in particular when a single motion arm assembly would be rated to carry a roughneck device.

In an embodiment it is preferred that the one or more motion arm assemblies 70, 71, 72, 80, 81, 82, e.g. at least one, is provided with a motion arm assembly vertical drive that forms part of a heave motion synchronization system, e.g. an electronic control unit that controls the vertical drive motor 78. Herein this synchronization system is adapted to bring a motion arm assembly and any object carried thereby, e.g. a wellbore tool or a tubular retrieved from a storage rack, into a vertical motion that is synchronous with the heave compensation motion of a still to be described riser tension frame or lower frame section thereof. This synchronization capability of the motion arm assembly with the heave motion for example allows the transfer of such wellbore tool or tubular between a position outside of the riser tension frame and a position within the riser tension frame and aligned with the firing line.

In an embodiment it is envisaged that a motion arm assembly, preferably provided with said synchronization functionality, is provided with a man-riding basket or cage, e.g. allowing transfer of personnel to the riser tension frame while performing heave motion compensation motions relative to the tower 10. The riser tension frame can be equipped with a boarding station, e.g. with a safety door or other barrier, governing the transfer between the man-riding cage or basket and the riser tension frame.

The drawings show, as part of a wellbore activities device, a riser tension frame 200 that is to be suspended along the front side of the mast 10 by means of the hoisting device 50 and the trolley 20 in a manner that allows, as is known for riser tension frames, to perform a heave compensation of the frame 200. As preferred and depicted the frame 200 is a fixed length frame, so lacking internal heave compensation cylinders. For example the winch or winches of the hoisting device 50 are of the active heave compensation type and/or one or more heave compensation devices act on the cable from which the travelling block 51 is suspended. In yet another design a heave compensator device could be arranged between the fixed length frame and the trolley.

In a non-depicted embodiment the frame 200 is not suspended from the trolley 20 but from the top drive device 30, e.g. from bails connected to a part of the top drive device 30. The latter design is not preferred due to the need to have the top drive device 30 in place when operating the riser tension frame 200 and the strains placed on the top drive device 30 requiring a heavy design thereof.

In general the riser tension frame 200 comprises:

- an upper frame section 210 adapted to be suspended or suspended from said heave compensated hoisting device,
- a lower frame section 250 provided with a riser attachment device 260 adapted to attach a riser 270 to said lower frame section so as to extend in a firing line,
- vertical riser load bearing struts 230, 231, 232 connecting said lower frame section 250 to said upper frame section 210.

The wellbore activities device further comprises:

- a coiled tubing injector 300,
- a wireline lubricator 400,
- a CT pressure control device 320 associated with the coiled tubing injector 300
- a WL pressure control device 420 associated with the wireline lubricator 400.

As depicted here each of the coiled tubing injector 300 and the wireline lubricator 400 is received by and individually movable within the riser tension frame 200 between a parking position remote from the firing line 3 and an operative position aligned with the firing line 3 allowing to use a selected one of said coiled tubing injector and said wireline lubricator for performing a coiled tubing operation or a wireline operation respectively when aligned with the firing line.

As explained in the introduction many operations involving coiled tubing and/or wireline require the use of long and slender wellbore tools, e.g. bottomhole assemblies to be fitted at the leading end of the coiled tubing string or wireline. Also such tools can be arranged at intermediate positions in the string in some cases.

As explained, according to some aspects of the invention, it is proposed to perform the transfer of for example such expensive and rather fragile slender wellbore tools 150 by means of one or more of the motion arm assemblies, e.g. as here motion arm assembly 71. Even, as explained during heave motion compensation operation, such transfer might be performed if the motion arm assembly is suitably motorized or otherwise.

Figure 8:
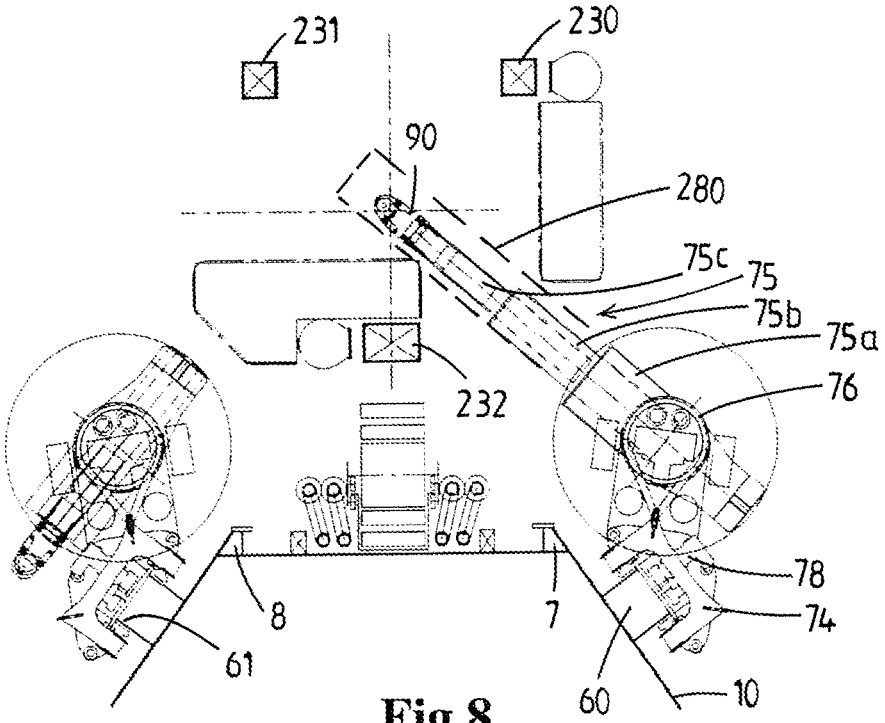
FIG. 8 shows schematically a horizontal section through the riser tension frame of FIG. 3 and the tower with motion assemblies thereon at the height of the upper walkway between the upper frame section and the CT injector.
Figure 12:
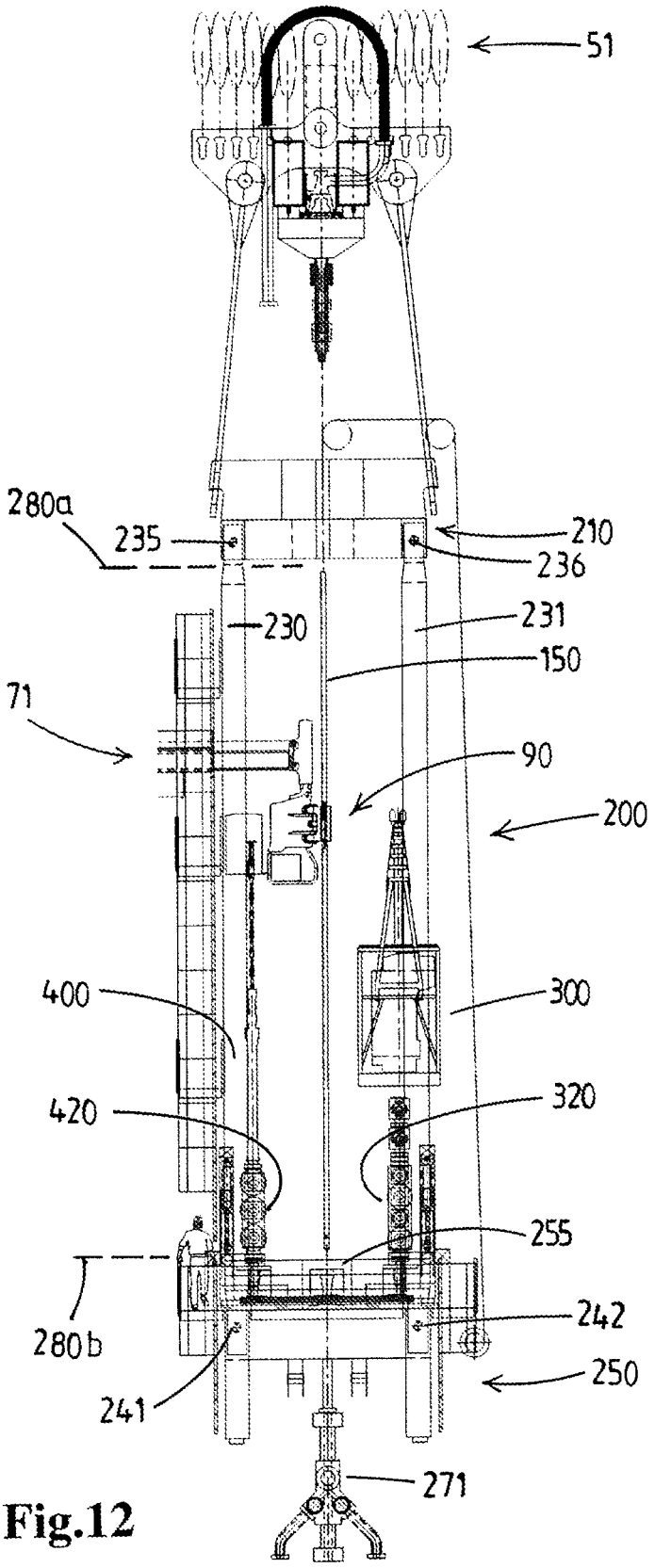
FIGS. 12 and 13 illustrate in view onto the front and in a median cross-section of the riser tension frame of FIG. 3 respectively the ability to transfer an elongated wellbore tool or tubular by means of a motion arm assembly between a position outside the frame to a position within the frame and aligned with the firing line.
Figure 13:
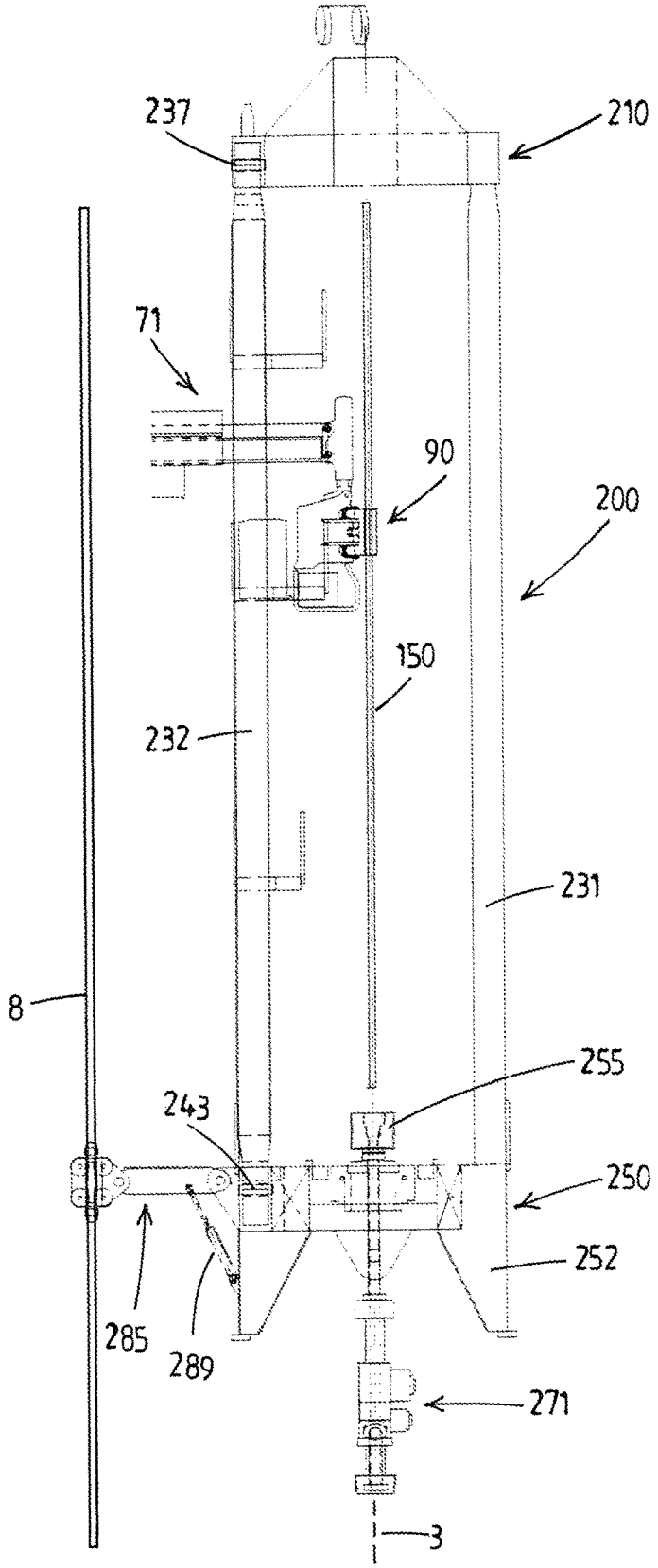
Figures 14A, 14B, 14C, 14D, 14E, 14F:
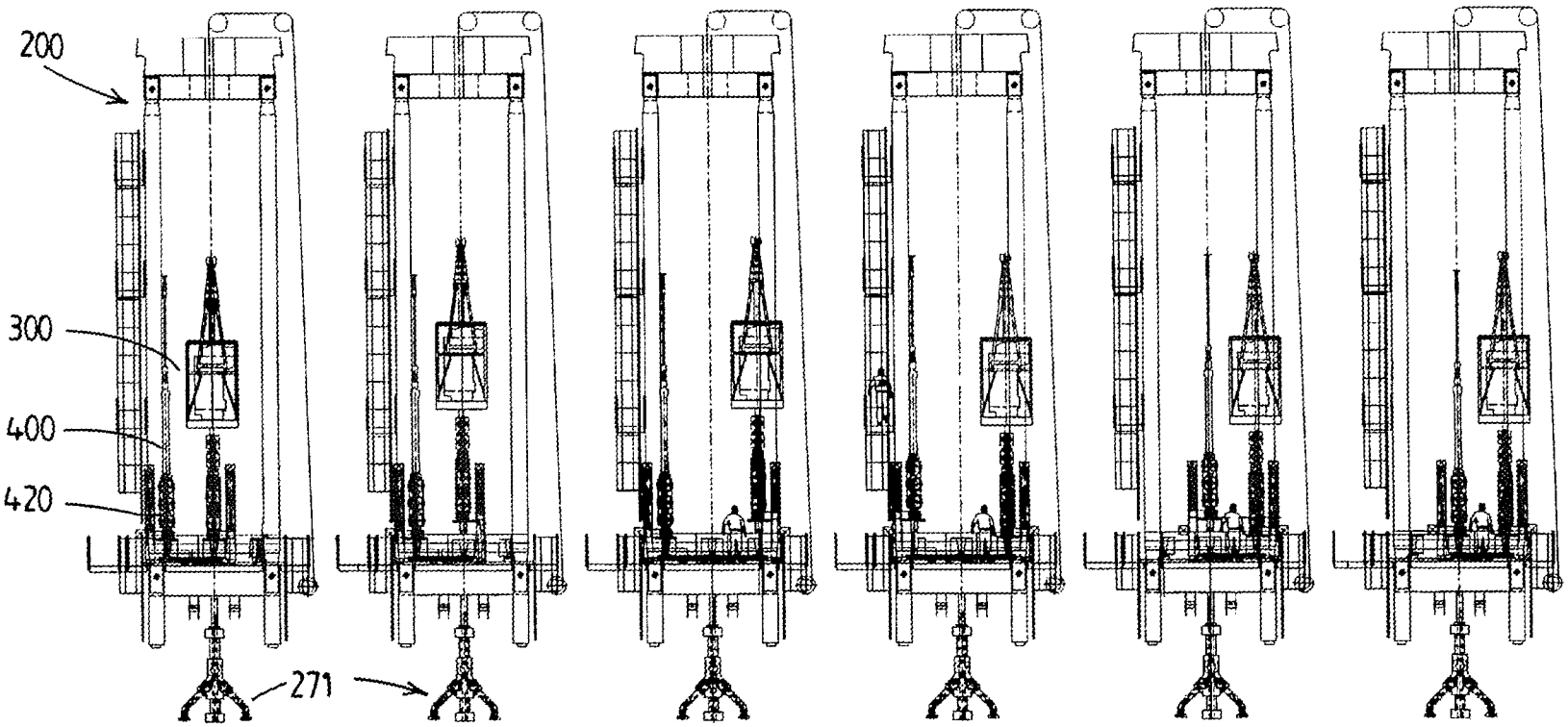
FIGS. 14*a-f* illustrate in a view onto the front of the riser tension frame of FIG. 3 the ability to switch from a coiled tubing operation to a wireline operation.
Figure 15:
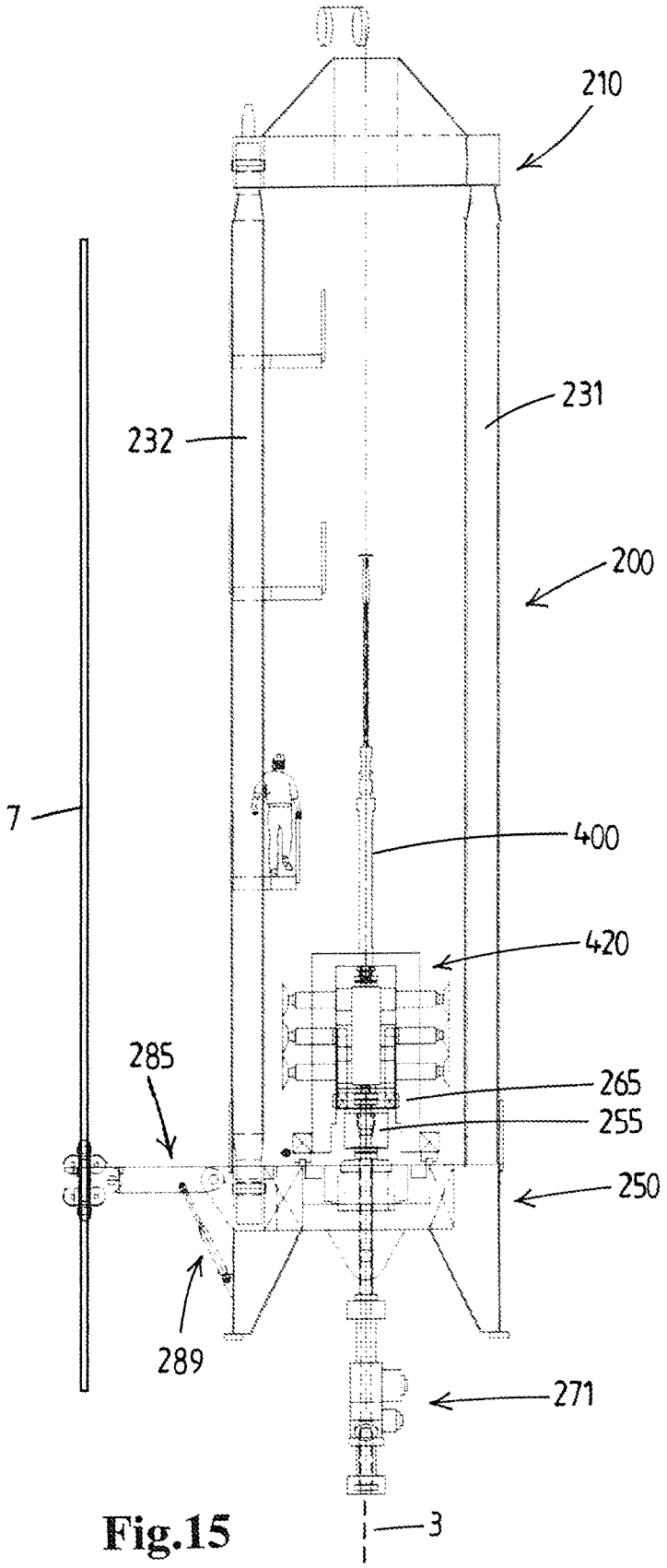
FIG. 15 illustrates performing a wireline operation using the riser tension frame of FIG. 3.
Figure 16:
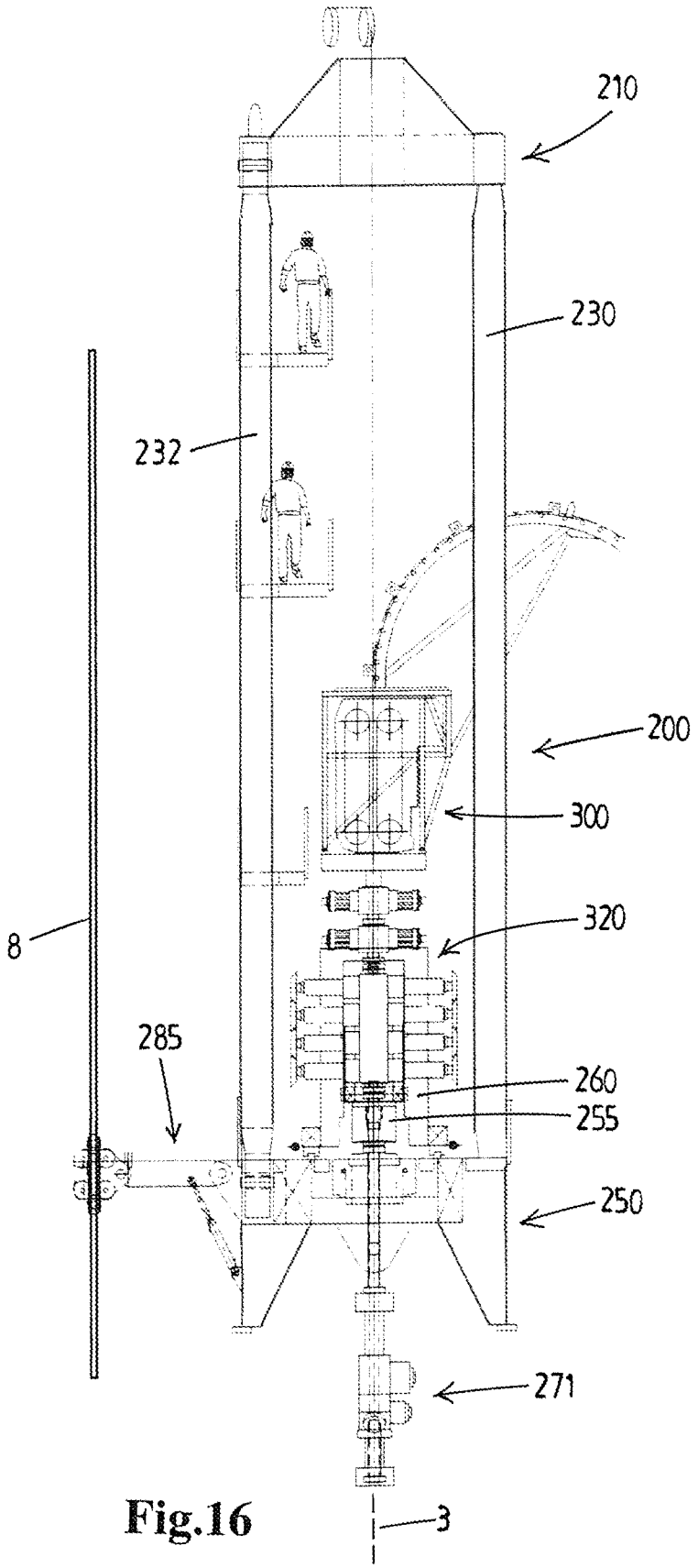
FIG. 16 illustrates performing a coiled tubing operation using the riser tension frame of FIG. 3.

In order to allow for this use of the one or more motion arm assemblies it is envisaged that the wellbore activities device, here the tension frame 200 plus preferably the CT injector 400, WL lubricator 300, and associated pressure control devices 320, 420 and any other components installed in or on said frame 200, such as walkways, provides a lateral firing line access passage 280 (depicted with dashed line in FIG. 8,10; FIG. 12 illustrates the upper and lower borders 290*a,b* of passage 280) having a height of at least 40 ft., e.g. of 50 ft., and a width of at least 1 ft. allowing to transfer an elongated wellbore tool 150 or a wellbore tubular in vertical orientation thereof by means of the motion arm assembly 71 in a substantially lateral motion between and a remote position outside of the riser tension frame 200 and an operative position within the riser tension frame and aligned with the firing line 3.

It is envisaged that, e.g. in a lower zone thereof, the passage 280 is dimensioned to allow for the transfer of objects having a greater cross-sectional dimension than a relatively slender wellbore tool or wellbore tubular. For example the passage 280 has a lower zone that is dimensioned to allow for access to the firing line 3 of a roughneck device held on the arm of a motion arm assembly, e.g. to assist in making or breaking of threaded connections, possibly with a tubular also being held in the firing line by an arm of a higher located arm assembly. Of course one can envisage that the passage 280 is wide over its entire height, e.g. 3 ft. or more, instead of being wide in a lower zone and narrow in an upper zone.

One can also envisage that a motion arm assembly on the tower 10 is used to handle one or more of the:

- a coiled tubing injector 300,
- a wireline lubricator 400,
- a CT pressure control device 320 associated with the coiled tubing injector 300
- a WL pressure control device 420 associated with the wireline lubricator 400.

For example a motion arm assembly is used to transfer such a component into and/or out of the frame 200, possibly with said frame 200 then being arranged out of alignment with the firing line in order to facilitate access to the component by means of the motion arm assembly as such transfer does not necessitate proper alignment with the firing line.

Figure 18:
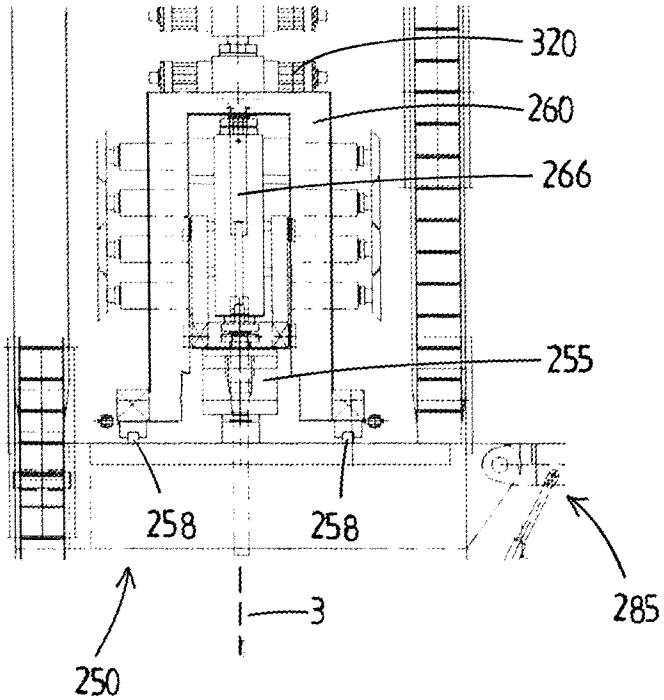
FIG. 18 illustrates in a view on the right-hand side the carrier for the pressure control device associated with the coiled tubing injector, said carrier travelling on rails on the platform of the lower frame section.
Figure 17:
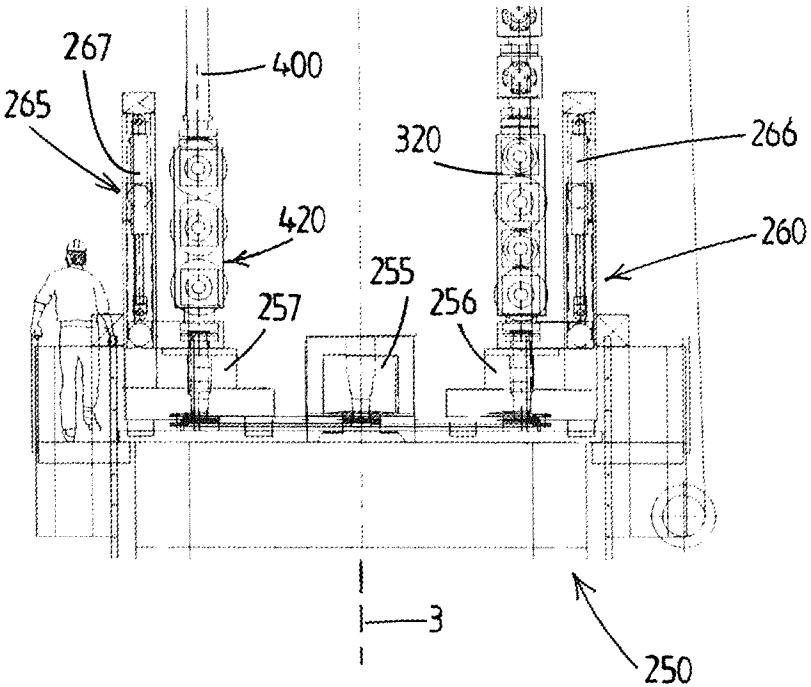
FIG. 17 illustrates a portion of the lower frame section of the riser tension frame of FIG. 3, with the arrangement of the carriers on the platform thereof in a front view.
Figure 19:
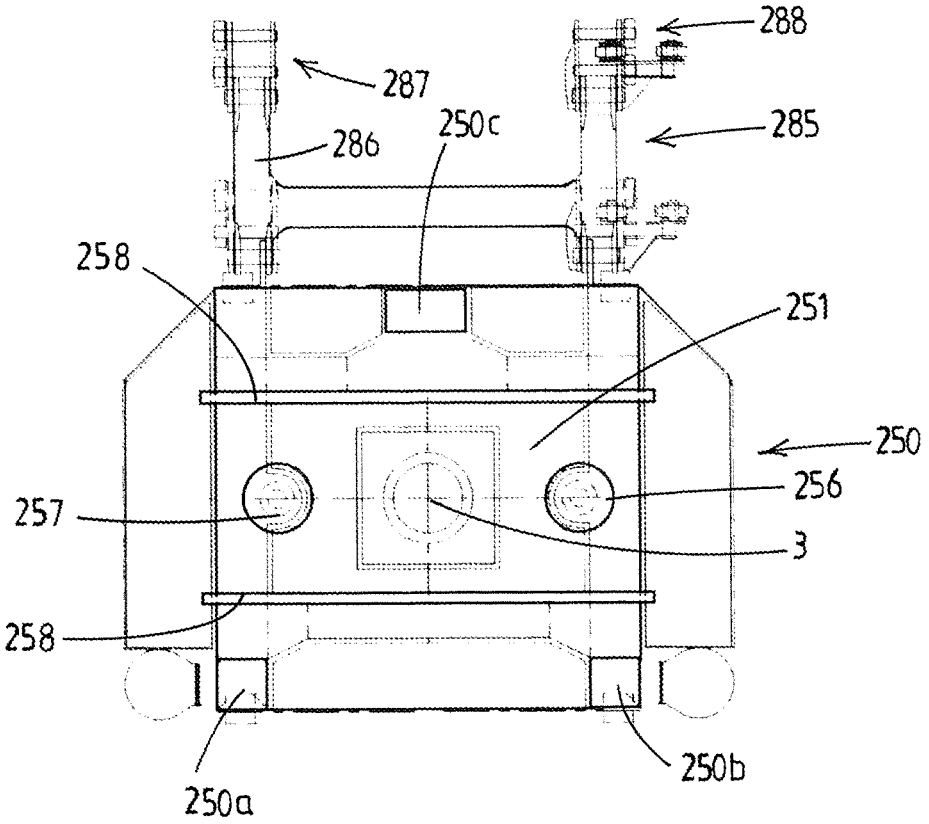
FIG. 19 shows a plan view onto the lower frame section of the tension frame of FIG. 3 with the carriers etc. removed, also showing the mobile arm structure of the lower frame section in both extended and retracted position.
Figure 22:
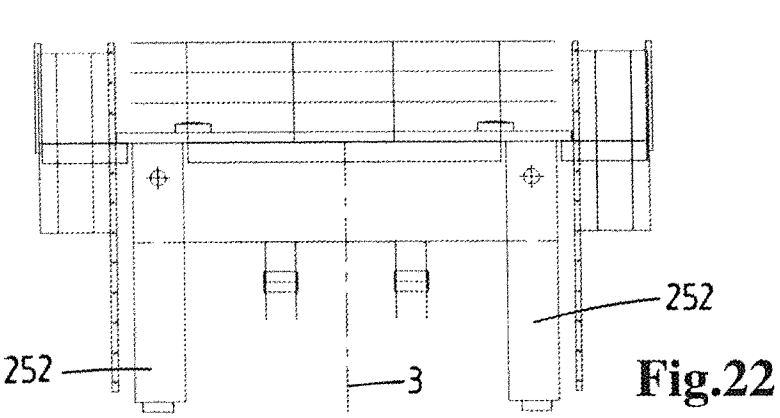
FIG. 22 shows a front view onto the lower frame section of the tension frame of FIG. 3.
Figure 20:
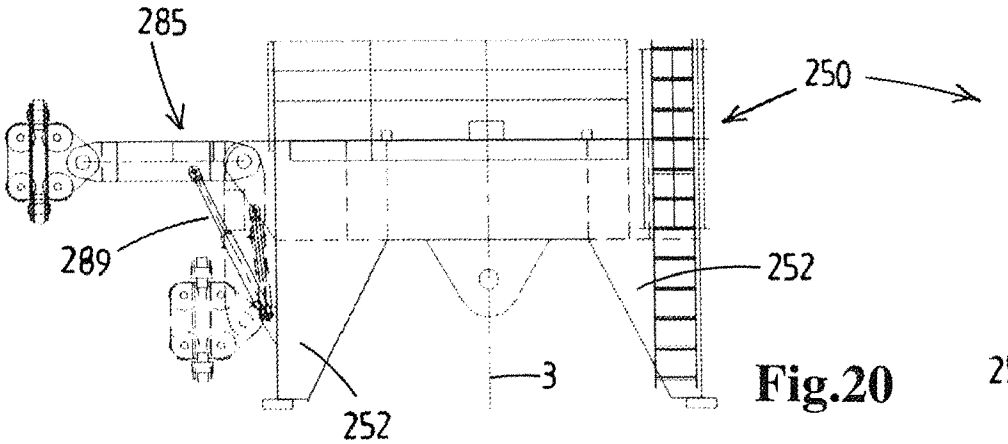
FIG. 20 shows a right-hand view onto the lower frame section of the tension frame of FIG. 3.
Figure 23:
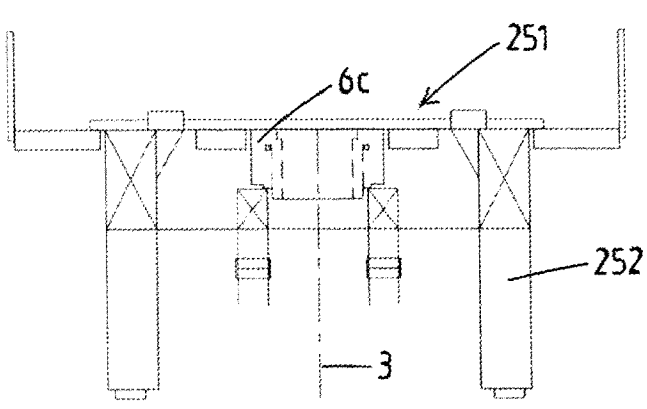
FIG. 23 shows a cross-section of the lower frame section of the tension frame of FIG. 3.
Figure 21:
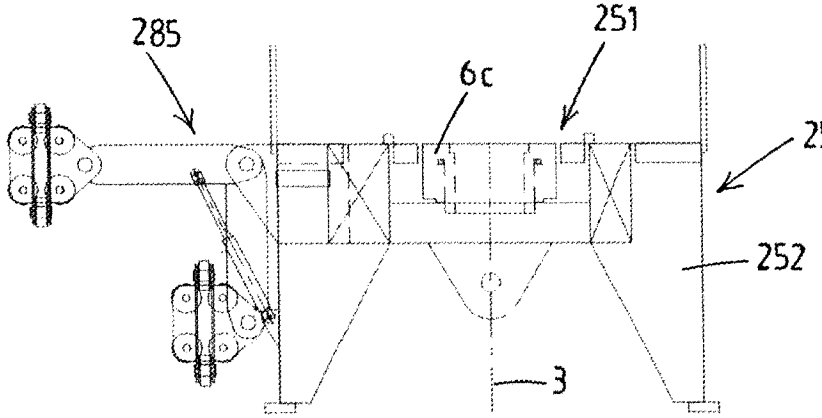
FIG. 21 shows a median cross-section of the lower frame section of the tension frame of FIG. 3.

As illustrated, e.g. in FIGS. 17, 18, the lower frame section 250 is releasably secured to the vertical riser load bearing structure, here to the struts, and the lower frame section comprises a platform 251 adapted to stand on a rig floor 4 in an operative position over the well center 5.

The lower frame section 250 supports, above the platform 251, the coiled tubing injector 300, the wireline lubricator 400, and the associated pressure control devices 320,420.

Figure 29:
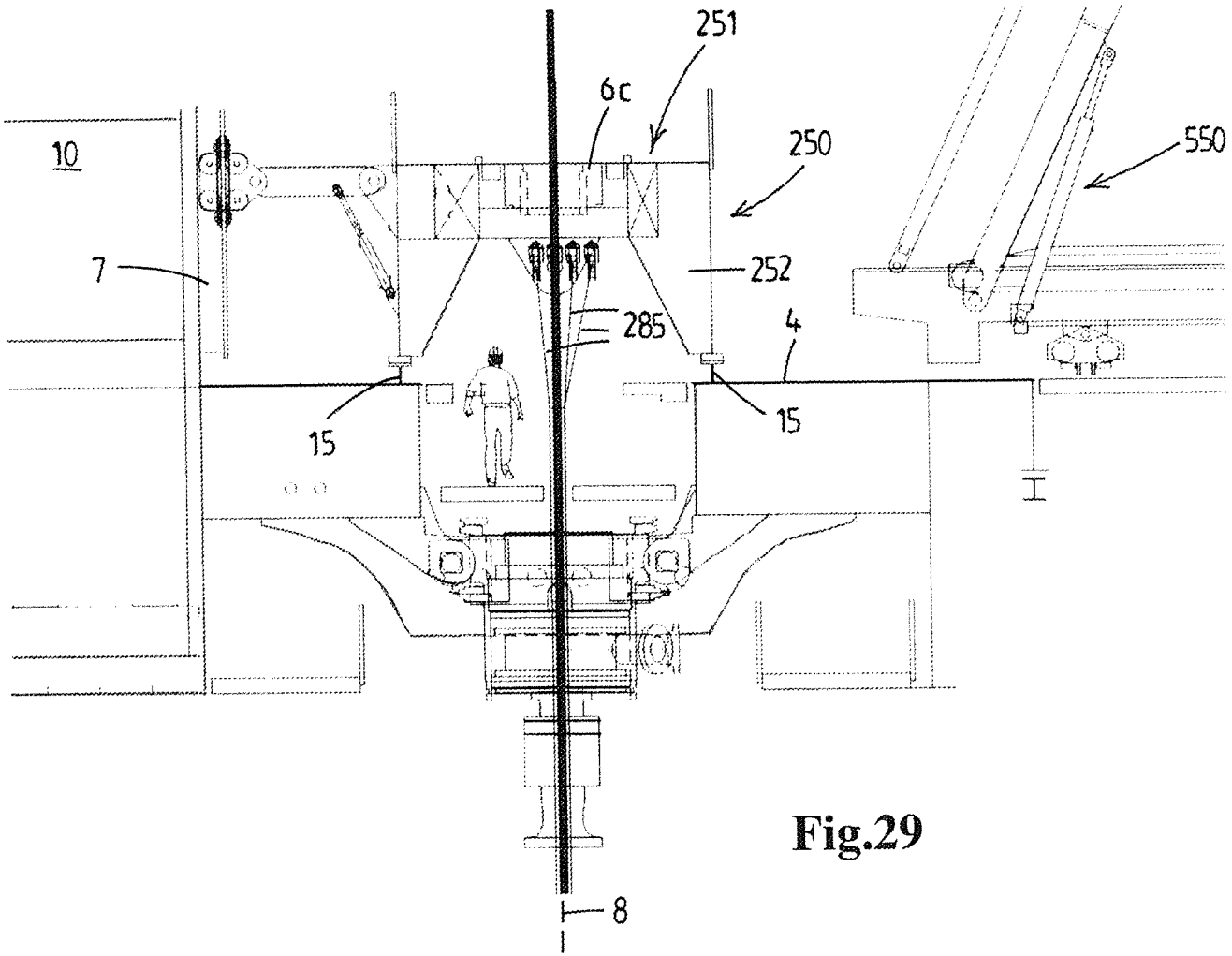
FIG. 29 illustrates the use of the lower frame section of the riser tension frame of FIG. 3 as a control and signal lines deployment module that stands on the rig floor, e.g. in the course of running production tubulars string into a wellbore in well completion, the string being provided with external control and signal lines.

The versatility of the removable lower frame section 250 is further depicted in FIG. 29, where the lower frame section 250 comprises platform 251 with downward projecting support legs 252 protruding beneath the platform and standing on a rig floor 4 in an operative position over the well center, wherein platform 251 is at an elevated position above the rig floor. The lower frame section 250 here has been cleared of the coiled tubing injector 300, the wireline lubricator 400, and the associated pressure control devices 320,420. Instead, e.g. in a receptacle space formed in the lower frame section below the platform surface, a slip device 6*c* is arranged which is adapted to support a tubulars string suspended from the slip device 6*c*. For example the height between the platform 250 and an underlying floor. E.g. the rig floor or a temporary floor located at a level lower than the rig floor, is such that a person can stand underneath the platform, so a height of at least 2 meters. This arrangement may be advantageous when running a tubular string to which one or more control or signal lines 285 are to be secured externally by said person, e.g. by means of clamps that are fitted at intervals on the tubular string, e.g. at every threaded connector between joined tubulars. The lower frame section 250 may comprise attachment members for one or more sheaves or other conductors of such control or signals lines, e.g. said lines coming from remotely located spools, e.g. arranged in a separate carrier on the rig floor remote from the well center.

The versatility of the removable lower frame section 250 is further depicted in FIG. 30, where the lower frame section 250 is placed on top of a group of heave motion compensation cylinders 295, e.g. on four of such cylinders to perform heave compensating motion in an associated range of travel along the tower 10. This may e.g. be done with the lower frame section merely being provided with the mentioned slip device 6*c*, but one can also envisage such a use wherein the lower frame section is provided with either a coiled tubing injector 300 and associated pressure control device 320 and/or with a wireline lubricator 400 and associated pressure control device 420.

As illustrated here, see e.g., FIGS. 17, 18, the lower frame section 250 has platform 251 wherein centrally a riser top connector 255 is arranged that is to be aligned with the firing line 3 in operations. The riser top connector here means a connector for coiled tubing and/or wireline equipment to the top end of the riser 270. Commonly, as here, a surface flow tree 271 may be arranged in the top region of the riser 270, below the platform 251. For example the connector 255 is a HydraConn connector as is known in the art.

The platform is provided with a CT storage stand 256 to store thereon a coiled tubing (CT) pressure control device 320 and with a WL storage stand 257 to store therein a wireline (WL) pressure control device 420. The CT storage stand 256 and WL storage stand 257 are arranged on diametrically opposed location relative to central riser top connector 255. In embodiments the stand 256 and/or stand 257 is provided with a connector, e.g. a HydraConn connector, similar to connector 255.

Also rails 258 are provided on said platform 251, here as preferred a pair of rails extending from left to right and along the front and the rear of the region where one can exchangeably fit the connector 255 or the slip device 6*c*.

The platform is provided with CT pressure control device carrier 260 that travels over said rails 258 and is adapted to carry and displace the CT pressure control device 320 from the CT storage stand 256 to the firing line 3 for connection to the riser top connector 255 and vice versa. Also the platform is provided with WL pressure control device carrier 265 that travels over rails 258 and is adapted to carry and displace the WL pressure control device 420 from the WL storage stand 257 to the firing line 3 for connection to the riser top connector 255 and vice versa.

It is depicted that the coiled tubing injector 300 is fitted on top of the coiled tubing pressure control device 320 and is moved by the carrier 260 as a unit between the parked position and the operative position in the firing line. In another embodiment a separate carrier is provided for the injector 300, allowing to move the injector separate from the associated pressure control device 320. The same may be done for the wireline lubricator 400 and its associated pressure control device 420. For example an intermediate horizontal frame member is fitted in the structure of the frame 200 at a level above the pressure control devices 320, 420, with one or more carriers being provided on said intermediate horizontal frame member to perform transfer of the injector 300 and/or lubricator 400 between a parked position and a firing line position. For example such an additional carrier may include a lifting mechanism adapted to lift and lower the carried injector 300 and/or lubricator 400 relative to the associated pressure control device 320, 420 in view of making and breaking the connection.

The carriers 260, 265 here each include a lifting mechanism, here including one or more hydraulic jacks 266, 267, allowing to controllably raise and lower the respective component or unit of components, e.g. to obtain release from the storage stand and to mate with the connector 255 and vice versa.

Concerning the structure of the tension frame 200 it is envisaged, in embodiments, that the vertical riser load bearing struts 230, 231, 232, connecting the lower frame section 250 to the upper frame section 210 are releasable at both ends. So struts 230, 231, 232 are each connected at an upper end thereof via a releasable connection, e.g. via a removable connector pin 235, 236, 237 to upper frame section 210. The struts 230, 231, 232 are each connected at a lower end thereof via a releasable connection, e.g. via a removable connector pin, 241, 242, 243 to lower frame section 250. As depicted here the upper and lower frame section 210, 250 each comprises sockets 250*a,b,c* that are each adapted to receive therein a lower spigot end of a strut. And for each releasable connection a transverse connector pin 235, 236, 237, 241, 242, 243 is provided that extends through aligned apertures in the socket and the spigot end of the strut.

It will be appreciated that such modular design of the tension frame allows for reduced storage space when disassembled.

It will be appreciated that onboard assembly of riser tension frame 200 is possible if the vessel is equipped with a proper crane, which is common for such vessels. For example one could proceed position the lower frame section 250 on deck within reach of a crane, then raise the vertical riser load bearing struts 230, 231, 232 by the crane and placed them vertically with their spigot ends in the sockets of the lower frame section 250 and then secure them therein by means of said transverse connector pins. Then, subsequently, the upper frame section 210 is placed on the vertically arranged struts 230, 231, 232 by means of the crane so that the top spigot ends of the struts are received in the corresponding sockets of the upper frame section 210 and then secured therein by means of transverse connector pins.

It will be appreciated that a removable pin type connection is proposed between the lower frame section 250 and the remainder of the riser tension frame 250, which may be done irrespective of the presence of struts or an alternative vertical load bearing construction. In an embodiment the pins are driven by an associated actuator, e.g. hydraulic jack, mounted on the lower frame section to facilitate the release and engagement of these connector pins.

It is illustrated that the lower frame section 250 is releasably secured to vertical load bearing structure, e.g. to struts 230,231,232, and that the lower frame section comprises a platform 251 adapted to stand on a rig floor 4 in an operative position over the well center, possibly provided with downward projecting support legs 252 protruding beneath the platform so that said platform stands at an elevated position above the rig floor.

The figures also depict that the lower frame section 250 is provided with a mobile arm structure 285 having one or more mobile arms 286, here pivotally connected about a horizontal pivot axis to the rear side of the lower frame section 250. The mobile arm structure is provided with one or more rail engagement members, here two rollers sets 287, 288, each adapted to engage on a respective vertical rails, here each on a respective vertical trolley rails 7, 8. The frame section 250 preferably comprises one or more actuators 289, e.g. hydraulic jacks, to perform the motion of the mobile arm structure 285.

As preferred the rail or rails onto which the arm structure 285 engages extends so low towards or even onto the level of the rig floor 4 that that when the lower frame structure stands on the rig floor the rail engagement members, here roller sets 287, 288, can be brought into engagement with the respective rail. This allows to use to arm structure as both a positioner for the frame section (to guarantee alignment with the firing line) and as a stabilizer, e.g. absorbing horizontal forces acting on the frame section 250 during various operations.

Figure 2:
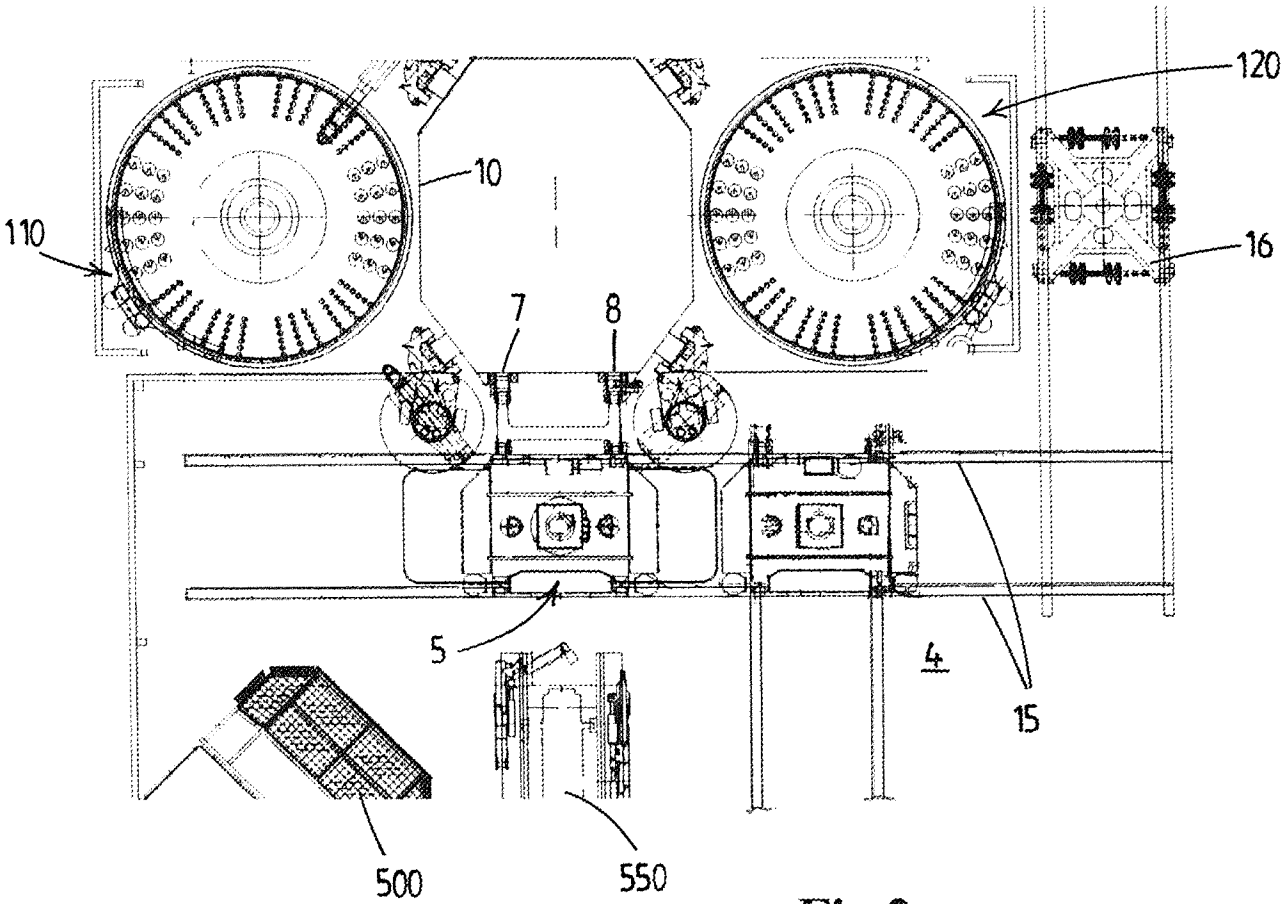
FIG. 2 shows in plan view the layout of the part of FIG. 1 with an embodiment of the lower frame section of the inventive riser tension frame in two positions on the skid rails, with a skid pallet, a drillers cabin, and a catwalk machine.
Figure 3:
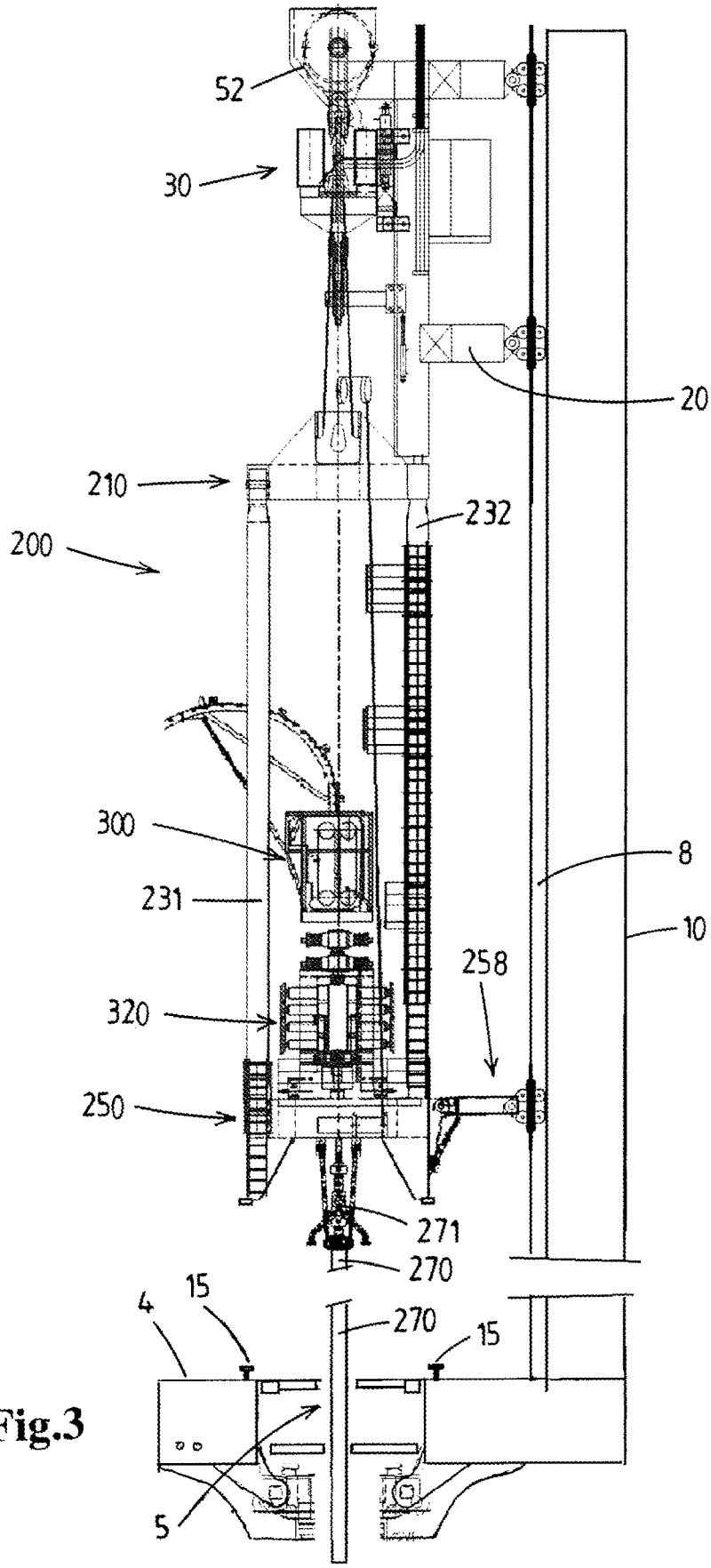
FIG. 3 shows in side view on the right-hand side, schematically and partly in cross-section, an embodiment of the inventive riser tension frame suspended in heave motion compensating manner from the tower above the rig floor.
Figure 4:
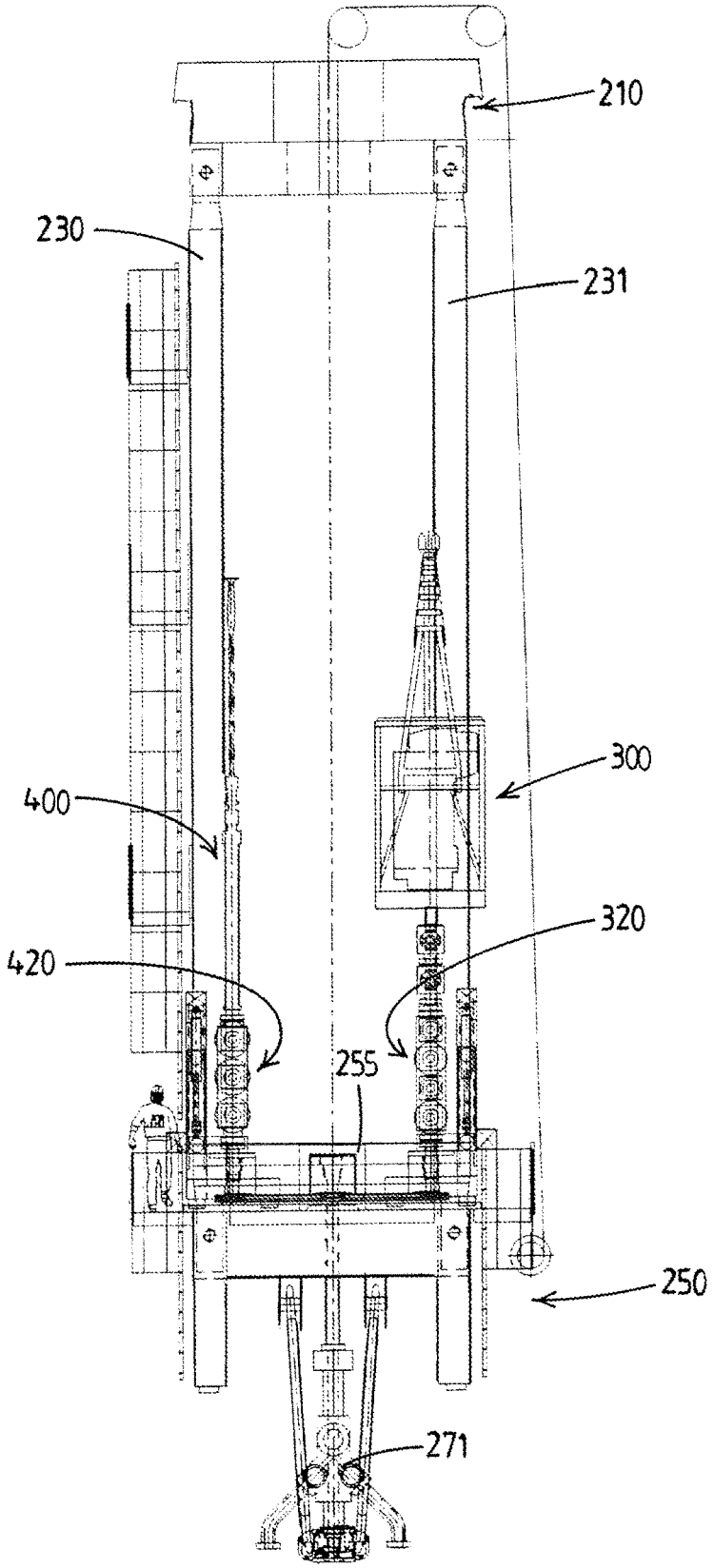
FIG. 4 illustrates a front view onto the riser tension frame of FIG. 3.
Figure 5:
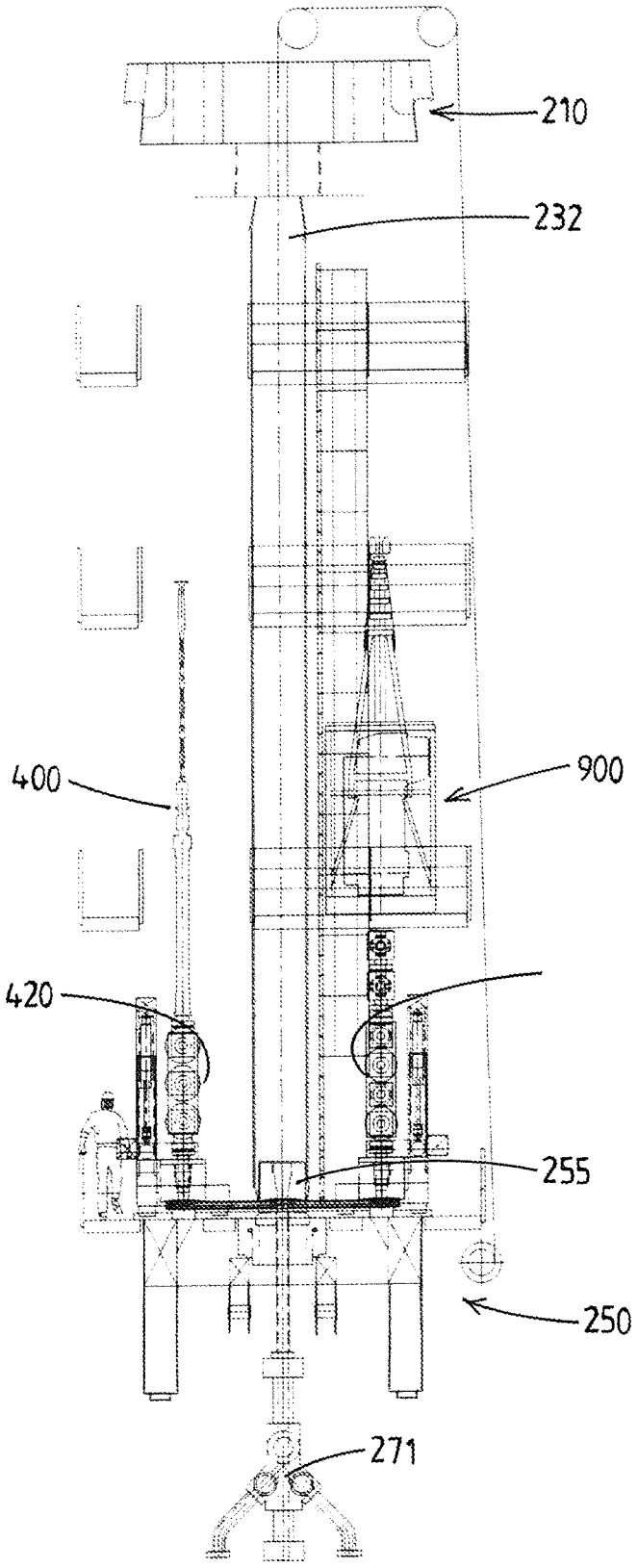
FIG. 5 shows a cross-sectional view through the firing line, similar to the front view, of the wellbore drilling installation with a top drive device according to the invention, riser tension frame of FIG. 3.
Figure 6:
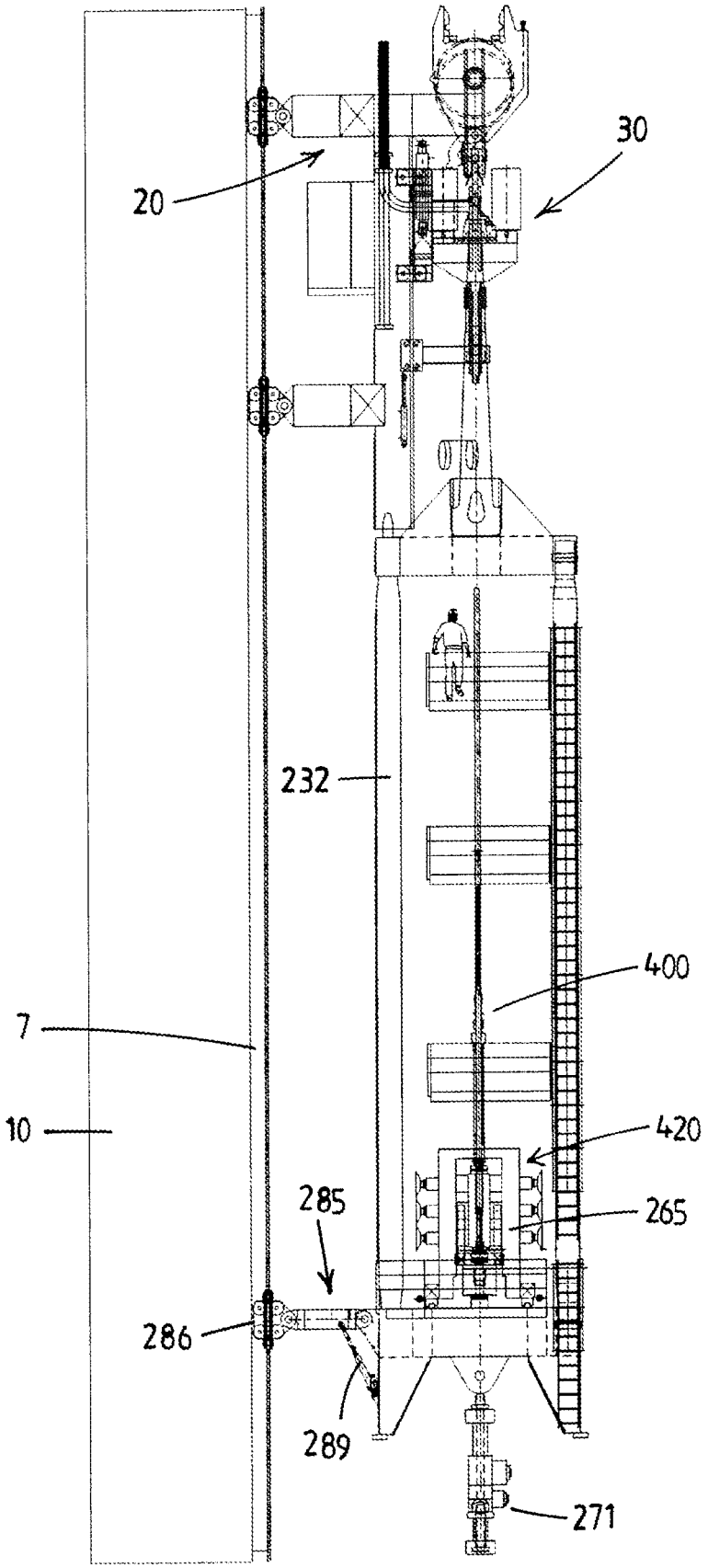
FIG. 6 shows in side view on the left-hand side, schematically and partly in cross-section, an embodiment of the inventive riser tension frame suspended in heave motion compensating manner from the tower above the rig floor.

The depicted system also comprises a pair of parallel skid rails 15 provided on rig floor 4 and extending along opposed sides of the well center 5. It is envisaged that a skid pallet 16, see FIG. 2, is provided and adapted to be skidded over skid rails 15 provided on the rig floor 4. Herein the lower frame section 250 is adapted to be releasably secured to this skid pallet 16 so as to allow skidding of the complete riser tension frame 200 or of just the lower frame section 250, e.g. with at least one of said coiled tubing injector 300, said wireline lubricator 40), and one or more pressure control devices 320,420 associated with said coiled tubing injector and/or said wireline lubricator supported thereon, or with slip device 6*c*, from a remote storage position to a position in the firing line 3.

FIG. 2 also depicts part of the driller's cabin 500, which overlooks the area of the well center 5 on the rig floor 4 as well as the front face of the tower 10 and thus the riser tension frame 200 when suspended along the front of the tower 10.

FIG. 2, as well as FIG. 29, also show part of a catwalk machine 550 which is present to handle tubulars as is known in the art.

Figure 26:
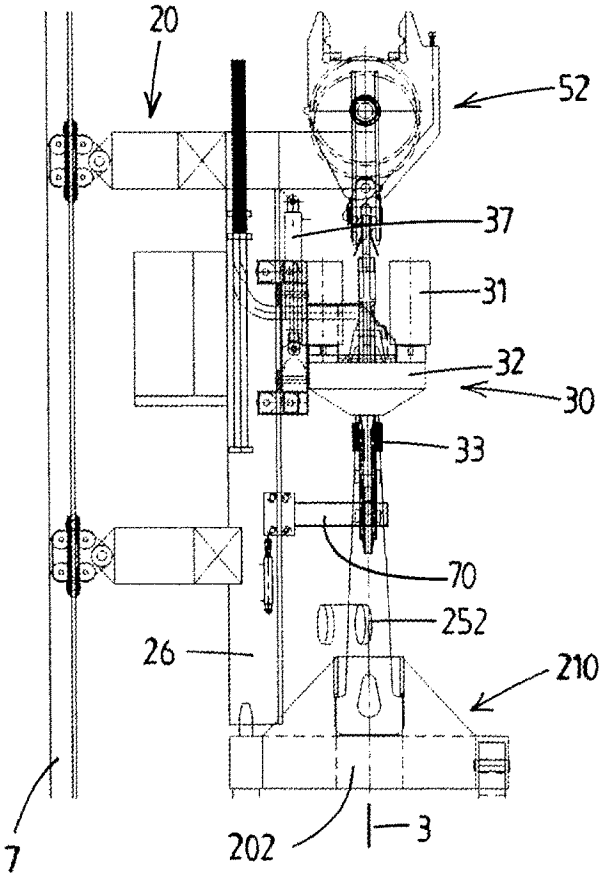
FIG. 26 illustrates the ability of the top drive to be lowered, e.g. in view of make-up and break-up of threaded connections, to be lowered relative to the trolley whilst the riser tension frame remains suspended therefrom at the same height.
Figure 25:
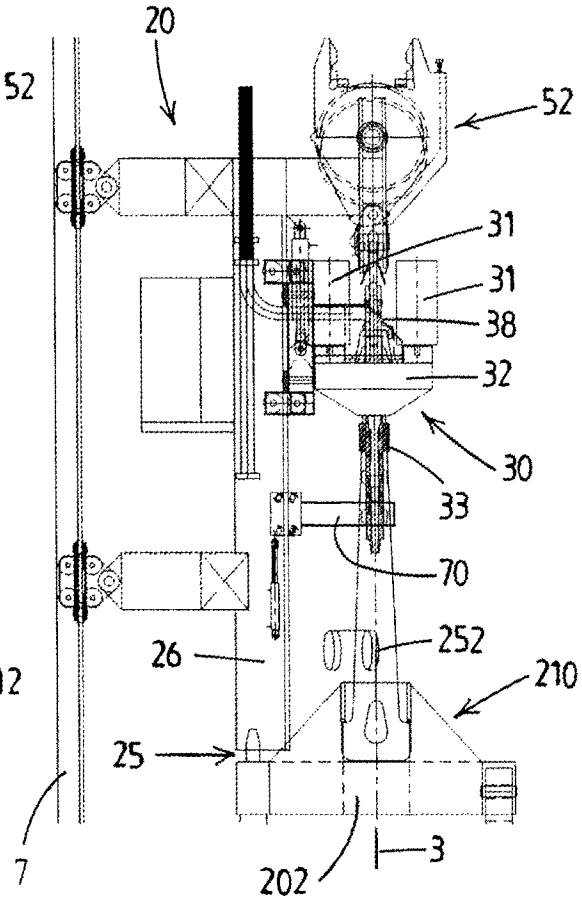
FIG. 25 illustrates the same suspension as FIG. 23 in a left-hand side view.
Figure 24:
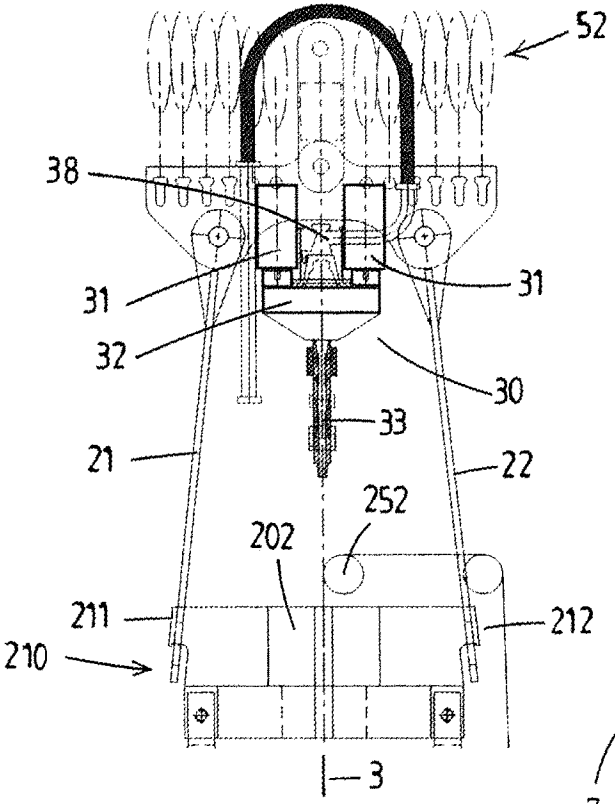
FIG. 24 illustrates, in a front view, the suspension of the riser tension frame of FIG. 3 from the trolley on the tower, which trolley is provided with a top drive.
Figure 27D:
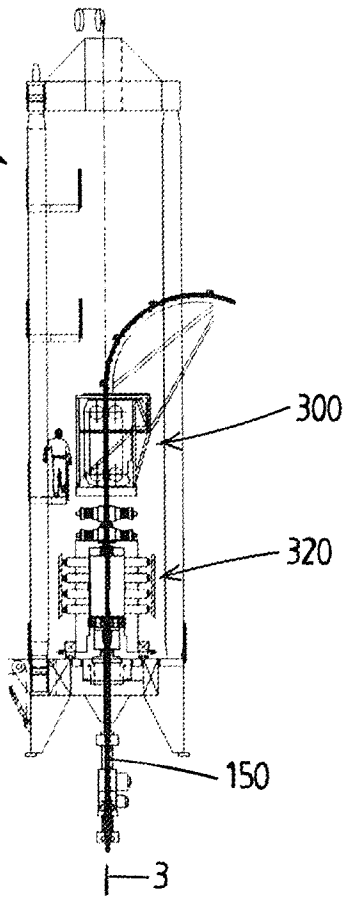
FIGS. 27*a-d* illustrate the start of a coiled tubing operation wherein a CT bottomhole assembly is first transferred into the riser tension frame of FIG. 3 by means of a motion arm assembly and brought into alignment with the firing line, after which the BHA is lowered and then the pressure control device and the CT injector are moved into position aligned with the firing line and made operational.
Figure 27C:
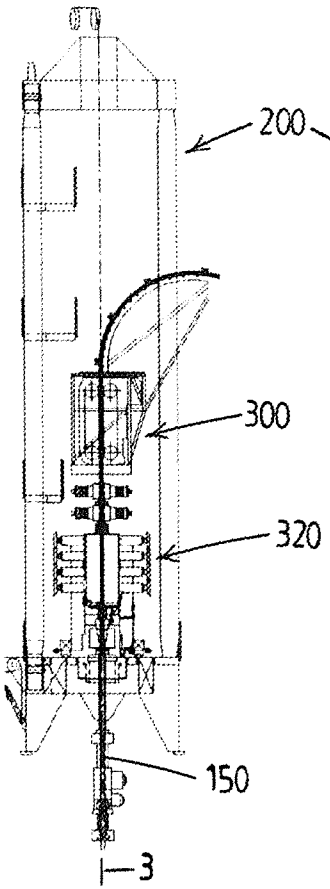
Figure 27B:
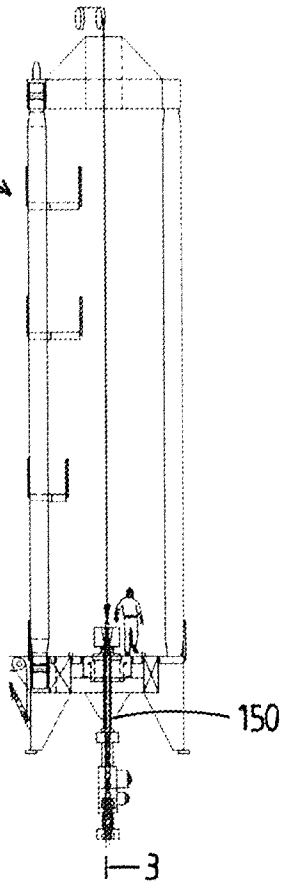
Figure 27A:
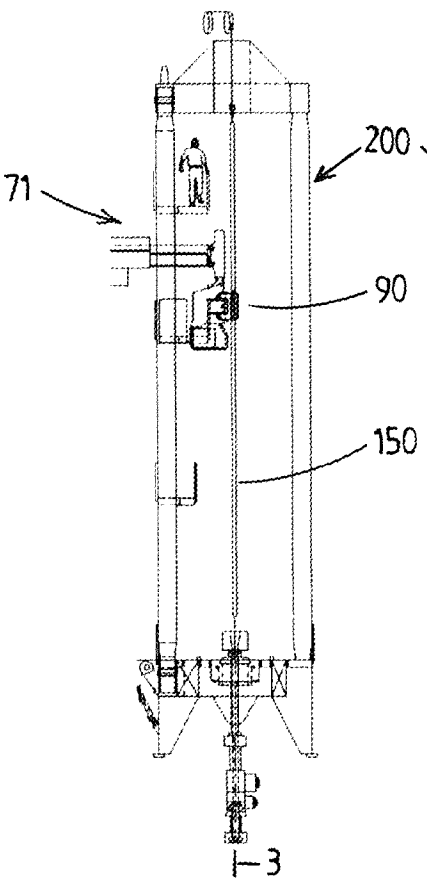
Figures 28A, 28B, 28C, 28D, 28E:
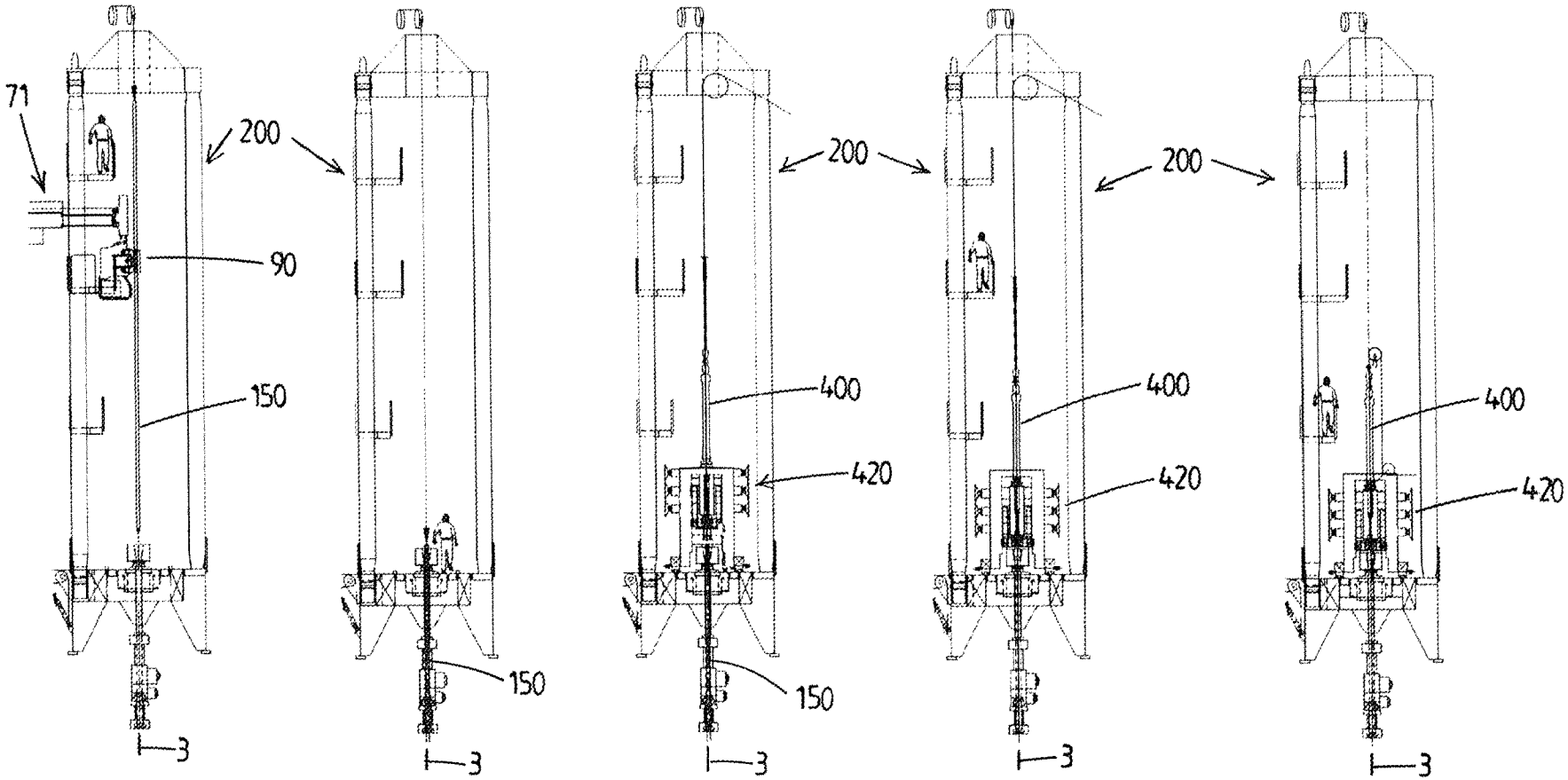
FIG. 28*a-e* illustrate the start of a wireline operation wherein a WL bottomhole assembly is first transferred into the riser tension frame of FIG. 3 by means of a motion arm assembly and brought into alignment with the firing line, after which the BHA is lowered and then the pressure control device and the WL lubricator are moved into position aligned with the firing line and made operational.

As best illustrated in FIGS. 24, 25, 26 it is envisaged that the riser tension frame 200 is directly suspended from the trolley 20, so that the vertical riser load is not transferred through any part of the top drive device 50.

As depicted there the frame of the trolley 20 is provided with a pair of mobile tensile links 21, 22, here outwardly pivotable, that depend from the trolley and are connected or connectable to the top frame section 210 of the riser tension frame 200. Here each of the tensile links 21, 22 has an eyelet at the lower end thereof and the tension frame top section has opposed hooks 211, 212 that can be mated with an eyelet of the link 21,22, here a left-hand and right-hand hook 211, 212.

As depicted the riser tension frame 200 and the trolley 20 have a spigot and socket connection arrangement 25, se FIG. 25, here at the location of the top end of a rear strut 232, so as to obtain a positioning and stabilizing of the frame 200 relative to the trolley by said spigot and socket connection. For example a single spigot and socket connection is provided in combination with two tensile links 21, 22 connecting to the top frame section at other locations to arrive at a triangular arrangement of connections between the trolley and the top section 210.

As depicted, in an embodiment, the trolley 20 has a vertical central rear frame member 26 on which the top drive device 30 is vertically guided, e.g. allowing to lower the top drive device 30 down along the member 26 when removing the top drive 30 from the trolley 20.

As depicted, in an embodiment, the rear frame member 26 of the trolley 20 lines up with the rear strut 232 of the frame 200 and interconnects therewith directly, e.g. via the mentioned connection 26 or another connection.

As depicted in FIGS. 25, 26 it is envisaged that the top drive device 30 is supported by the trolley 20 in a manner that allows for vertical mobility of the device 30, e.g. in view of making or breaking a tubular connection, e.g. a threaded connection. For example a top drive vertical motion actuator 37 is provided between the top drive 30 and the trolley 20. A wrench device 70 may be provided on the trolley 20 to assist in this process.

It is illustrated that the riser tension frame 200 has a vertical firing line access passage 202 all the way from the top section 210 to the lower frame section 250, in particular extending through the top section in the firing line 3. This allows for the use of the top drive 30, e.g. of the mud swivel commonly associated with the top drive 30, or of an independent mud swivel 38, in operations using the tension frame 200.

Figure 7:
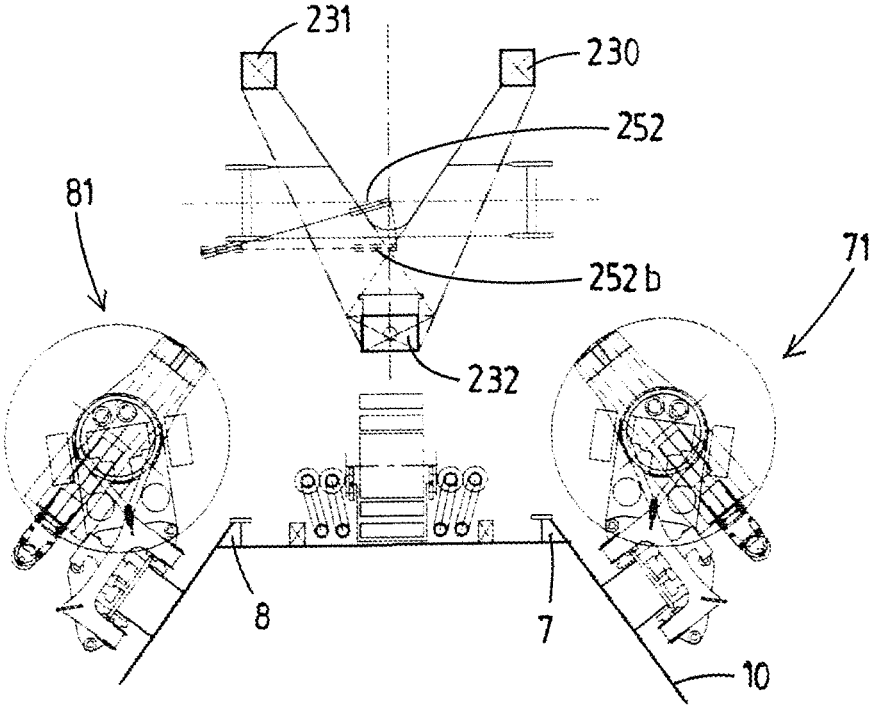
FIG. 7 shows schematically a horizontal section through the riser tension frame of FIG. 3 and the tower with motion assemblies thereon at the height of the upper frame section.
Figure 10:
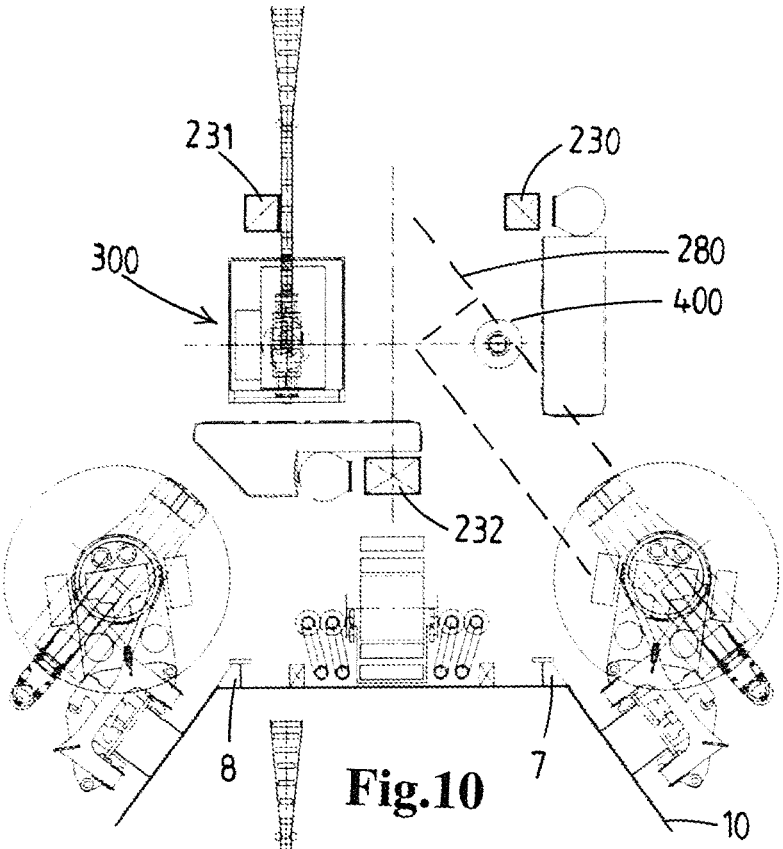
FIG. 10 shows schematically a horizontal section through the riser tension frame of FIG. 3 and the tower with motion assemblies thereon at the height of lower walkway.
Figure 9:
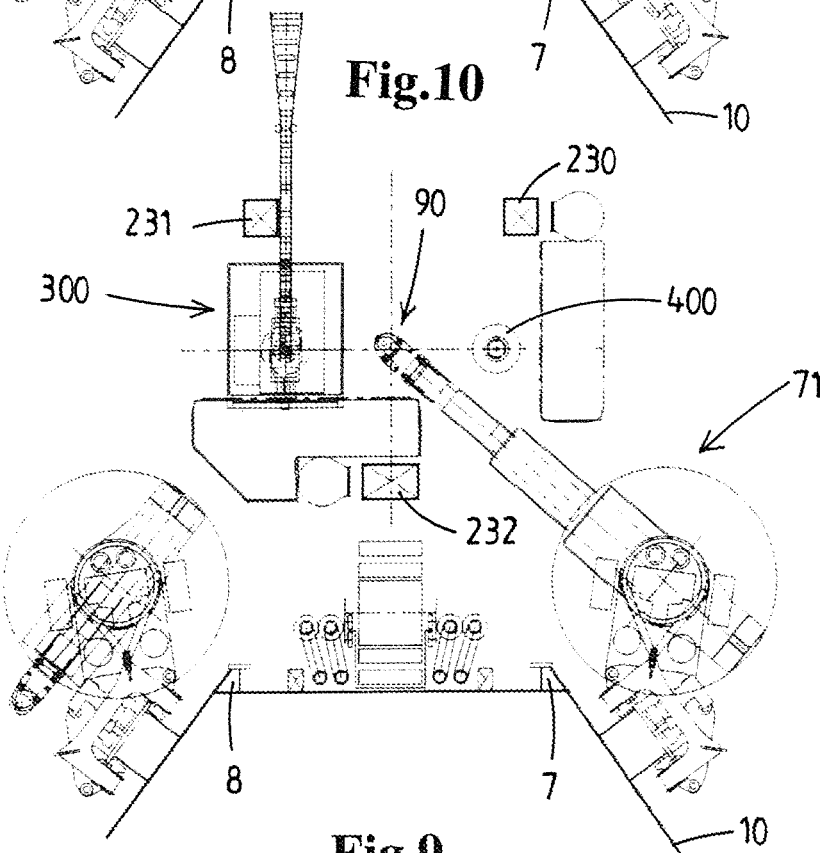
FIG. 9 shows schematically a horizontal section through the riser tension frame of FIG. 3 and the tower with motion assemblies thereon at the height of the middle walkway above CT injector.
Figure 11:
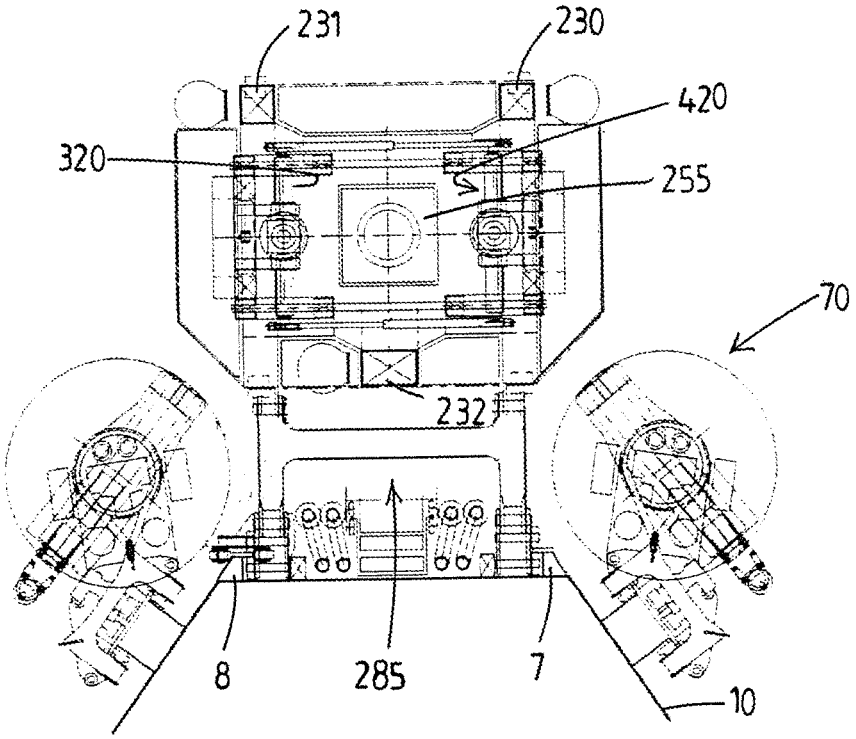
FIG. 11 shows schematically a horizontal section through the riser tension frame of FIG. 3 and the tower with motion assemblies thereon at the height above the pressure control devices associated with the CT injector and WL lubricator.

The top frame section 250 is provided with a mobile top sheave 252 that is displaceable between a firing line position where a cable or wire can be passed from the top sheave along the firing line and a retracted or parked position (see 252*b* in FIG. 7) wherein the firing line 3 and thus the passage 202 is cleared.

The invention claimed is:

1. An offshore subsea wellbore activities system comprising:

an offshore vessel having a hull subjected to heave motion, said vessel being provided with:

a tower;

a well center through which a firing line extends;

a heave compensated hoisting device;

a vertical motion arm rail along said tower;

a motion arm assembly comprising a base and an extensible and retractable motion arm, wherein the base is guided by said vertical motion arm rail;

a motion arm assembly vertical drive which is adapted to move the motion arm base along said vertical motion arm rail relative to the tower; and a wellbore activities device comprising a riser tension frame, wherein said riser tension frame comprises:

an upper frame section adapted to be suspended or suspended from said heave compensated hoisting device;

a lower frame section provided with a riser attachment device adapted to attach a riser to said lower frame section so as to extend in a firing line; and vertical riser load bearing structure connecting said lower frame section to said upper frame section, wherein said vertical riser load bearing structure is formed by three vertical riser load bearing struts connecting said lower frame section to said upper frame section in a triangular arrangement, including one rear strut arranged at a rear side of the tension frame facing the tower and two front struts at a front side of the tension frame, wherein said wellbore activities device further comprises:

a coiled tubing injector;

a wireline lubricator; and one or more pressure control devices associated with one or more of said coiled tubing injector and said wireline lubricator, wherein each of said coiled tubing injector and said wireline lubricator is received by and individually movable within said riser tension frame between a parking position remote from said firing line and an operative position aligned with said firing line allowing to use a selected one of said coiled tubing injector and said wireline lubricator for performing a coiled tubing operation or a wireline operation respectively when aligned with the firing line, wherein the wellbore activities device provides a lateral firing line access passage having a height of at least 40 ft. and a width of at least 1 ft. allowing to transfer an elongated wellbore tool or a wellbore tubular in a vertical orientation thereof by means of the motion arm assembly in a substantially lateral motion between a remote position outside of the riser tension frame and an operative position within the riser tension frame and aligned with the firing line, and wherein the lateral firing line access is located between the rear strut and one of the front struts of the vertical riser load bearing structure.

2. The system according to claim 1, wherein the system further comprises:

at least one tubulars storage rack adjacent the tower and adapted to store therein tubulars in vertical orientation, and a tubular gripper member adapted to be provided or provided on said motion arm and adapted to grip a tubular, so that said tubular is displaceable by means of said motion arm between the storage rack and said firing line.

3. The system according to claim 1, wherein said lower frame section is releasably secured to said vertical riser load bearing structure, wherein said lower frame section comprises a platform adapted to stand on a rig floor in an operative position over the well center, and wherein said lower frame section supports, above the platform, at least one of said coiled tubing injector, said wireline lubricator, and said one or more pressure control devices associated with one or more of said coiled tubing injector and/or said wireline lubricator.

4. The system according to claim 1, wherein said lower frame section is releasably secured to said vertical riser load bearing structure, wherein said lower frame section comprises a platform that is provided with downward projecting support legs protruding beneath the platform and that is adapted to stand on a rig floor in an operative position over the well center, wherein said platform is at an elevated position above the rig floor, wherein said system further comprises a slip device that is adapted to support a tubulars string suspended from said slip device, and wherein the platform of the lower frame section is adapted to receive and retain said slip device.

5. The system according to claim 1, wherein said lower frame section is releasably connected to said vertical riser load bearing structure of the tension frame, wherein said lower frame section comprises a platform wherein centrally a riser top connector is arranged that is to be aligned with the firing line, wherein the platform is provided with a coiled tubing (CT) storage stand configured to store thereon a coiled tubing pressure control device and with a wireline (WL) storage stand configured to store therein a wireline pressure control device, wherein said CT storage stand and said WL storage stand are arranged on diametrically opposed locations relative to said central riser top connector, wherein rails are provided on said platform, wherein the platform is provided with CT pressure control device carrier that is adapted to travel over said rails and is adapted to carry and displace the CT pressure control device from the CT storage stand to the firing line for connection to the riser top connector and vice versa, and wherein the platform is provided with WL pressure control device carrier—that is adapted to travel over said rails and is adapted to carry and displace the WL pressure control device from the WL storage stand to the firing line for connection to the riser top connector and vice versa.

6. The system according to claim 1, wherein vertical riser load bearing struts are present that connect said lower frame section to said upper frame section, wherein said struts are each connected at an upper end thereof via a releasable connection, to said upper frame section, wherein said struts are each connected at a lower end thereof via a releasable connection, to said lower frame section, wherein said upper and lower frame section each comprises sockets that are each adapted to receive therein a spigot end of a strut, and wherein for each releasable connection a transverse connector pin is provided that extends through aligned apertures in the socket and in the spigot end of the strut.

7. The system according to claim 1, wherein the lower frame section is releasably secured to said vertical load bearing structure, wherein said lower frame section comprises a platform adapted to stand on a rig floor in an operative position over the well center, wherein the lower frame section is provided with a mobile arm structure having one or more mobile arms, and wherein said mobile arm structure is provided with one or more rail engagement members adapted to engage on one or more of said vertical rails.

8. The system according to claim 1, wherein the system comprises:

a pair of parallel skid rails provided on a rig floor and extending along opposed sides of the well center, and a skid pallet adapted to be skidded over said pair of parallel skid rails provided on the rig floor, wherein said lower frame section is adapted to be releasably secured to said skid pallet so as to allow skidding of the complete riser tension frame or of the lower frame section with said at least one of said coiled tubing injector, said wireline lubricator, and said one or more pressure control devices associated with one or more of said coiled tubing injector and said wireline lubricator supported thereon, from a remote storage position to a position in the firing line.

9. The system according to claim 1, wherein the system comprises:

one or more vertical trolley rails along the tower, a trolley suspended from the heave compensated hoisting device and movable along said one or more vertical trolley rails, and a top drive device supported by the trolley, wherein the riser tension frame is directly suspended from the trolley, the vertical riser load not being transferred through any part of the top drive device.

10. The system according to claim 1, wherein the system comprises:

one or more vertical trolley rails along the tower, a trolley suspended from the heave compensated hoisting device and movable along said one or more vertical trolley rails, and a top drive device supported by the trolley, wherein the riser tension frame is directly suspended from the trolley, the vertical riser load not being transferred through any part of the top drive device, and wherein the riser tension frame and the trolley have a spigot and socket connection arrangement, so as to obtain a positioning and stabilizing of the frame relative to the trolley by said spigot and socket connection.

11. A method for performing wellbore activities comprising the step of using the system according to claim 1, wherein the motion arm assembly is used to transfer an elongated wellbore tool or a wellbore tubular in vertical orientation thereof by means of the motion arm assembly in a substantially lateral motion between a remote position outside of the riser tension frame and an operative position within the riser tension frame and aligned with the firing line via the lateral firing line access passage.

12. An offshore subsea wellbore activities system comprising:

an offshore vessel having a hull subjected to heave motion, said vessel being provided with:

a tower;

a well center through which a firing line extends;

a heave compensated hoisting device;

a vertical motion arm rail along said tower;

a motion arm assembly comprising a base and an extensible and retractable motion arm, wherein the base is guided by said vertical motion arm rail; and a motion arm assembly vertical drive which is adapted to move the motion arm base along said vertical motion arm rail relative to the tower; and a wellbore activities device comprising a riser tension frame, wherein said riser tension frame comprises:

an upper frame section adapted to be suspended or suspended from said heave compensated hoisting device;

a lower frame section provided with a riser attachment device adapted to attach a riser to said lower frame section so as to extend in a firing line;

vertical riser load bearing structure connecting said lower frame section to said upper frame section, wherein said wellbore activities device further comprises:

a coiled tubing injector;

a wireline lubricator; and one or more pressure control devices associated with one or more of said coiled tubing injector and said wireline lubricator, wherein each of said coiled tubing injector and said wireline lubricator is received by and individually movable within said riser tension frame between a parking position remote from said firing line and an operative position aligned with said firing line allowing to use a selected one of said coiled tubing injector and said wireline lubricator for performing a coiled tubing operation or a wireline operation respectively when aligned with the firing line, wherein the wellbore activities device provides a lateral firing line access passage having a height of at least 40 ft. and a width of at least 1 ft. allowing to transfer an elongated wellbore tool or a wellbore tubular in a vertical orientation thereof by means of the motion arm assembly in a substantially lateral motion between a remote position outside of the riser tension frame and an operative position within the riser tension frame and aligned with the firing line, wherein said lower frame section is releasably connected to said vertical riser load bearing structure of the tension frame, wherein said lower frame section comprises a platform wherein centrally a riser top connector is arranged that is to be aligned with the firing line, wherein the platform is provided with a coiled tubing (CT) storage stand configured to store thereon a coiled tubing pressure control device and with a wireline (WL) storage stand configured to store therein a wireline pressure control device, wherein said CT storage stand and said WL storage stand are arranged on diametrically opposed locations relative to said central riser top connector, wherein rails are provided on said platform, wherein the platform is provided with CT pressure control device carrier that is adapted to travel over said rails and is adapted to carry and displace the CT pressure control device from the CT storage stand to the firing line for connection to the riser top connector and vice versa, and wherein the platform is provided with WL pressure control device carrier that is adapted to travel over said rails and is adapted to carry and displace the WL pressure control device from the WL storage stand to the firing line for connection to the riser top connector and vice versa.

13. The system according to claim 12, wherein the system further comprises:

at least one tubulars storage rack adjacent the tower and adapted to store therein tubulars in vertical orientation, and a tubular gripper member adapted to be provided or provided on said motion arm and adapted to grip a tubular, so that said tubular is displaceable by means of said motion arm between the storage rack and said firing line.

14. The system according to claim 12, wherein said vertical riser load bearing structure is formed by exactly three vertical riser load bearing struts connecting said lower frame section to said upper frame section in a triangular arrangement, including one rear strut arranged at a rear side of the tension frame facing the tower and two front struts at a front side of the tension frame.

15. The system according to claim 12, wherein said lower frame section is releasably secured to said vertical riser load bearing structure, wherein said lower frame section comprises a platform adapted to stand on a rig floor in an operative position over the well center, and wherein said lower frame section supports, above the platform, at least one of said coiled tubing injector, said wireline lubricator, and said one or more pressure control devices-associated with one or more of said coiled tubing injector and/or said wireline lubricator.

16. The system according to claim 12, wherein said lower frame section is releasably secured to said vertical riser load bearing structure, wherein said lower frame section comprises a platform that is provided with downward projecting support legs protruding beneath the platform and that is adapted to stand on a rig floor in an operative position over the well center, wherein said platform is at an elevated position above the rig floor, wherein said system further comprises a slip device that is adapted to support a tubulars string suspended from said slip device, and wherein the platform of the lower frame section is adapted to receive and retain said slip device.

17. The system according to claim 12, wherein vertical riser load bearing struts are present that connect said lower frame section to said upper frame section, wherein said struts are each connected at an upper end thereof via a releasable connection, to said upper frame section, wherein said struts are each connected at a lower end thereof via a releasable connection, to said lower frame section, wherein said upper and lower frame section each comprises sockets that are each adapted to receive therein a spigot end of a strut, and wherein for each releasable connection a transverse connector pin is provided that extends through aligned apertures in the socket and in the spigot end of the strut.

18. The system according to claim 12, wherein the lower frame section is releasably secured to said vertical load bearing structure, wherein said lower frame section comprises a platform adapted to stand on a rig floor in an operative position over the well center, wherein the lower frame section is provided with a mobile arm structure having one or more mobile arms, and wherein said mobile arm structure is provided with one or more rail engagement members adapted to engage on one or more of said vertical rails.

19. The system according to claim 12, wherein the system comprises:

a pair of parallel skid rails provided on a rig floor and extending along opposed sides of the well center, and a skid pallet adapted to be skidded over said pair of parallel skid rails provided on the rig floor, wherein said lower frame section is adapted to be releasably secured to said skid pallet so as to allow skidding of the complete riser tension frame or of the lower frame section with said at least one of said coiled tubing injector, said wireline lubricator, and said one or more pressure control devices associated with one or more of said coiled tubing injector and said wireline lubricator supported thereon, from a remote storage position to a position in the firing line.

20. The system according to claim 12, wherein the system comprises:

one or more vertical trolley rails along the tower, a trolley suspended from the heave compensated hoisting device and movable along said one or more vertical trolley rails, and a top drive device supported by the trolley, wherein the riser tension frame is directly suspended from the trolley, the vertical riser load not being transferred through any part of the top drive device.

21. The system according to claim 12, wherein the system comprises:

one or more vertical trolley rails along the tower, a trolley suspended from the heave compensated hoisting device and movable along said one or more vertical trolley rails, and a top drive device supported by the trolley, wherein the riser tension frame is directly suspended from the trolley, the vertical riser load not being transferred through any part of the top drive device, and wherein the riser tension frame and the trolley have a spigot and socket connection arrangement, so as to obtain a positioning and stabilizing of the frame relative to the trolley by said spigot and socket connection.

22. A method for performing wellbore activities comprising the step of using the system according to claim 12, wherein the motion arm assembly is used to transfer an elongated wellbore tool or a wellbore tubular in vertical orientation thereof by means of the motion arm assembly in a substantially lateral motion between a remote position outside of the riser tension frame and an operative position within the riser tension frame and aligned with the firing line via the lateral firing line access passage.

23. An offshore subsea wellbore activities system comprising:

an offshore vessel having a hull subjected to heave motion, said vessel being provided with:

a tower;

a well center through which a firing line extends;

a heave compensated hoisting device;

a vertical motion arm rail along said tower;

a motion arm assembly comprising a base and an extensible and retractable motion arm, wherein the base is guided by said vertical motion arm rail; and a motion arm assembly vertical drive which is adapted to move the motion arm base along said vertical motion arm rail relative to the tower; and a wellbore activities device comprising a riser tension frame, wherein said riser tension frame comprises:

an upper frame section adapted to be suspended or suspended from said heave compensated hoisting device;

a lower frame section provided with a riser attachment device adapted to attach a riser to said lower frame section so as to extend in a firing line; and vertical riser load bearing structure connecting said lower frame section to said upper frame section, wherein said vertical riser load bearing structure is formed by exactly three vertical riser load bearing struts connecting said lower frame section to said upper frame section in a triangular arrangement, including one rear strut arranged at a rear side of the tension frame facing the tower and two front struts at a front side of the tension frame, wherein said wellbore activities device further comprises:

a coiled tubing injector;

a wireline lubricator; and one or more pressure control devices associated with one or more of said coiled tubing injector and said wireline lubricator, wherein each of said coiled tubing injector and said wireline lubricator is received by and individually movable within said riser tension frame between a parking position remote from said firing line and an operative position aligned with said firing line allowing to use a selected one of said coiled tubing injector and said wireline lubricator for performing a coiled tubing operation or a wireline operation respectively when aligned with the firing line, wherein the lower frame section is provided with a coiled tubing storage stand to store thereon a coiled tubing pressure control device and with a wire line storage stand to store thereon a wireline pressure control device, wherein said coiled tubing storage stand and said wireline storage stand are arranged on diametrically opposed locations relative to a central riser top connector, and wherein the wellbore activities device provides a lateral firing line access passage having a height of at least 40 ft. and a width of at least 1 ft. allowing to transfer an elongated wellbore tool or a wellbore tubular in a vertical orientation thereof by means of the motion arm assembly in a substantially lateral motion between a remote position outside of the riser tension frame and an operative position within the riser tension frame and aligned with the firing line.

24. The system according to claim 23, wherein the system further comprises:

at least one tubulars storage rack adjacent the tower and adapted to store therein tubulars in vertical orientation, and a tubular gripper member adapted to be provided or provided on said motion arm and adapted to grip a tubular, so that said tubular is displaceable by means of said motion arm between the storage rack and said firing line.

25. The system according to claim 23, wherein said lower frame section is releasably secured to said vertical riser load bearing structure, wherein said lower frame section comprises a platform adapted to stand on a rig floor in an operative position over the well center, and wherein said lower frame section supports, above the platform, at least one of said coiled tubing injector, said wireline lubricator, and said one or more pressure control devices associated with one or more of said coiled tubing injector and/or said wireline lubricator.

26. The system according to claim 23, wherein said lower frame section is releasably secured to said vertical riser load bearing structure, wherein said lower frame section comprises a platform that is provided with downward projecting support legs protruding beneath the platform and that is adapted to stand on a rig floor in an operative position over the well center, wherein said platform is at an elevated position above the rig floor, wherein said system further comprises a slip device that is adapted to support a tubulars string suspended from said slip device, and wherein the platform of the lower frame section is adapted to receive and retain said slip device.

27. The system according to claim 23, wherein said lower frame section is releasably connected to said vertical riser load bearing structure of the tension frame, wherein said lower frame section comprises a platform wherein centrally a riser top connector is arranged that is to be aligned with the firing line, wherein the platform is provided with a coiled tubing (CT) storage stand configured to store thereon a coiled tubing pressure control device and with a wireline (WL) storage stand configured to store therein a wireline pressure control device, wherein said CT storage stand and said WL storage stand are arranged on diametrically opposed locations relative to said central riser top connector, wherein rails are provided on said platform, wherein the platform is provided with CT pressure control device carrier that is adapted to travel over said rails and is adapted to carry and displace the CT pressure control device from the CT storage stand to the firing line for connection to the riser top connector and vice versa, and wherein the platform is provided with WL pressure control device carrier—that is adapted to travel over said rails and is adapted to carry and displace the WL pressure control device from the WL storage stand to the firing line for connection to the riser top connector and vice versa.

28. The system according to claim 23, wherein vertical riser load bearing struts are present that connect said lower frame section to said upper frame section, wherein said struts are each connected at an upper end thereof via a releasable connection, to said upper frame section, wherein said struts are each connected at a lower end thereof via a releasable connection, to said lower frame section, wherein said upper and lower frame section each comprises sockets that are each adapted to receive therein a spigot end of a strut, and wherein for each releasable connection a transverse connector pin is provided that extends through aligned apertures in the socket and in the spigot end of the strut.

29. The system according to claim 23, wherein the lower frame section is releasably secured to said vertical load bearing structure, wherein said lower frame section comprises a platform adapted to stand on a rig floor in an operative position over the well center, wherein the lower frame section is provided with a mobile arm structure having one or more mobile arms, and wherein said mobile arm structure is provided with one or more rail engagement members adapted to engage on one or more of said vertical rails.

30. The system according to claim 23, wherein the system comprises:

a pair of parallel skid rails provided on a rig floor and extending along opposed sides of the well center, and a skid pallet adapted to be skidded over said pair of parallel skid rails provided on the rig floor, wherein said lower frame section is adapted to be releasably secured to said skid pallet so as to allow skidding of the complete riser tension frame or of the lower frame section with said at least one of said coiled tubing injector, said wireline lubricator, and said one or more pressure control devices associated with one or more of said coiled tubing injector and said wireline lubricator supported thereon, from a remote storage position to a position in the firing line.

31. The system according to claim 23, wherein the system comprises:

one or more vertical trolley rails along the tower, a trolley suspended from the heave compensated hoisting device and movable along said one or more vertical trolley rails, and a top drive device supported by the trolley, wherein the riser tension frame is directly suspended from the trolley, the vertical riser load not being transferred through any part of the top drive device.

32. The system according to claim 23, wherein the system comprises:

one or more vertical trolley rails along the tower, a trolley suspended from the heave compensated hoisting device and movable along said one or more vertical trolley rails, and a top drive device supported by the trolley, wherein the riser tension frame is directly suspended from the trolley, the vertical riser load not being transferred through any part of the top drive device, and wherein the riser tension frame and the trolley have a spigot and socket connection arrangement, so as to obtain a positioning and stabilizing of the frame relative to the trolley by said spigot and socket connection.

33. A method for performing wellbore activities comprising the step of using the system according to claim 23, wherein the motion arm assembly is used to transfer an elongated wellbore tool or a wellbore tubular in vertical orientation thereof by means of the motion arm assembly in a substantially lateral motion between a remote position outside of the riser tension frame and an operative position within the riser tension frame and aligned with the firing line via the lateral firing line access passage.

* * * * *